US008565652B2

(12) United States Patent
Terasaka et al.

(10) Patent No.: US 8,565,652 B2
(45) Date of Patent: Oct. 22, 2013

(54) DEVELOPMENT ROLLER, DEVELOPMENT DEVICE, PROCESS CARTRIDGE AND IMAGE-FORMING APPARATUS

(75) Inventors: Takumi Terasaka, Yokohama (JP); Toshio Kojima, Isehara (JP); Kyohta Koetsuka, Fujisawa (JP); Noriyuki Kamiya, Yamato (JP); Masayuki Ohsawa, Atsugi (JP); Hiroya Abe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/473,808

(22) Filed: May 17, 2012

(65) Prior Publication Data

US 2012/0294655 A1 Nov. 22, 2012

(30) Foreign Application Priority Data

May 18, 2011 (JP) ..... 2011-111411

(51) Int. Cl.
*G03G 15/09* (2006.01)

(52) U.S. Cl.
USPC ..... 399/276; 399/277

(58) Field of Classification Search
USPC ..... 399/276, 277
See application file for complete search history.

(56) References Cited

U.S. PATENT DOCUMENTS

| | | | | |
|---|---|---|---|---|
| 6,512,908 | B2 * | 1/2003 | Mitamura | 399/267 |
| 7,561,837 | B2 * | 7/2009 | Eck et al. | 399/267 |
| 7,925,192 | B2 * | 4/2011 | Kojima et al. | 399/276 |
| 7,970,322 | B2 * | 6/2011 | Ochiai | 399/276 |
| 2003/0170050 | A1 | 9/2003 | Terai | |
| 2007/0059047 | A1 | 3/2007 | Kamiya et al. | |
| 2007/0189810 | A1 | 8/2007 | Ohsawa | |
| 2008/0170891 | A1 * | 7/2008 | Abe et al. | 399/277 |
| 2009/0060591 | A1 * | 3/2009 | Kojima et al. | 399/276 |
| 2010/0158578 | A1 | 6/2010 | Kojima et al. | |
| 2011/0142501 | A1 | 6/2011 | Kamiya et al. | |
| 2011/0194874 | A1 | 8/2011 | Masuda et al. | |
| 2011/0274471 | A1 | 11/2011 | Ohsawa et al. | |
| 2012/0057907 | A1 | 3/2012 | Taguchi et al. | |

FOREIGN PATENT DOCUMENTS

| | | |
|---|---|---|
| JP | 2003-255692 | 9/2003 |
| JP | 2003-295599 | 10/2003 |
| JP | 2004-191835 | 7/2004 |
| JP | 2005-24611 | 1/2005 |
| JP | 2007-86091 | 4/2007 |
| JP | 2007-232788 | 9/2007 |
| JP | 2008-139650 | 6/2008 |
| JP | 2009-50447 | 4/2009 |

* cited by examiner

OTHER PUBLICATIONS

European search report dated Aug. 30, 2012 in connection with corresponding European patent application No. 12168571.3.

*Primary Examiner* — David Gray
*Assistant Examiner* — Geoffrey Evans
(74) *Attorney, Agent, or Firm* — Cooper & Dunham LLP

(57) ABSTRACT

A development roller includes a magnet roller and a rotatably supported development sleeve including inside thereof the magnet roller, the development sleeve is formed in a cylindrical shape and configured such that a shaft center of the cylindrical shape is inconsistent with a rotation axis of the development sleeve, the development sleeve includes an outer surface provided with many circular or elliptical depressions in a planar view, the depressions being regularly arranged at intervals, and a depth of the depression provided in a portion of the outer surface close to the rotation axis is larger than a depth of the depression provided in a portion of the outer surface far from the rotation axis.

9 Claims, 14 Drawing Sheets

DEVELOPMENT ROLLER, DEVELOPMENT DEVICE, PROCESS CARTRIDGE AND IMAGE-FORMING APPARATUS

PRIORITY CLAIM

The present application is based on and claims priority from Japanese Patent Application No. 2011-111411, filed on May 18, 2011, the disclosure of which is hereby incorporated by reference in its entirety.

BACKGROUND

1. Field of the Invention

The present invention relates to a development roller, development device, process cartridge and image-forming apparatus for use in a copier, facsimile, printer or the like. More specifically, the present invention relates to a development roller and a development device which feed developer carried on a development sleeve to a development area where a photoreceptor and a development sleeve face each other at an interval, and develop an electrostatic latent image on the photoreceptor to form a toner image. The present invention also relates to a process cartridge and an image-forming apparatus having the development device.

2. Description of the Related Art

An outer surface of a development sleeve is subjected to a sandblast process and an electromagnetic blast process which randomly crush linear members to the outer surface with a rotating magnetic field, and the outer surface is provided with grooves, such that developer carried on the development sleeve of a development roller in an image-forming apparatus is effectively fed to a photoreceptor drum.

With the sandblast process and the grooves on the outer surface of the development sleeve, the developer is prevented from slipping on the development sleeve rotating at high speed, and deterioration in an image concentration caused by remaining developer due to such slippage is also prevented.

The development sleeve having the outer surface subjected to the sandblast process is made of any one of aluminum alloy, brass, stainless steel and conductive resin, but the development sleeve is often made of aluminum alloy in order to reduce costs and improve process accuracy. In the sandblast process on the outer surface of the development sleeve made of aluminum alloy, asperities are formed on the outer surface by blowing out abrasive grains with a cold working process to an aluminum tube extruded into a development sleeve at high temperature. The surface roughness is about Rz 5-15 μm. The developer is caught on the asperities of the outer surface in the development sleeve subjected to the sand blast process even if the development sleeve rotates at high speed, so that the developer can be prevented from slipping.

However, the asperities formed on the outer surface of the development sleeve by the sandblast process are gradually grinded due to developer or the like because the asperities are very fine. For this reason, the development sleeve subjected to the sandblast process becomes flat because the asperities are grinded according to the increase in the number of printing sheets, namely, with the passage of time. Accordingly, the developer carrying amount of the development sleeve subjected to the sandblast process is gradually decreased, so that an image is gradually paled out. In this way, the development sleeve subjected to the sandblast process has a problem in durability. In order to solve such a problem, the development sleeve can be made of high hardness stainless steel, or the surface of the development sleeve can be subjected to a hardening process, but these are undesirable because these increase costs.

Moreover, the development sleeve having the outer surface provided with the grooves is made of any one of aluminum alloy, brass, stainless steel and conductive resin, but it is often made of aluminum alloy in order to reduce the costs and improve the processing accuracy. An aluminum tube extruded in a development sleeve shape at high temperature is removed, and the grooves are formed by a die with a cold working process. In general, the groove includes, for example, a sectional square shape, V-shape and U-shape, the groove depth from the outer surface of the development sleeve is about 0.2 mm and the number of grooves is about 50 in a development sleeve having an outer diameter of ϕ18. The developer is caught in the grooves on the outer surface of the development sleeve subjected to the groove process even if the development sleeve rotates at high speed, so that the developer is prevented from slipping.

The groove formed on the outer surface of the development sleeve is significantly larger than the asperity formed by the sandblast process. With this configuration, the groove is difficult to wear, and the developer-carrying amount is not decreased with the passage of time. Namely, the development sleeve having the outer surface provided with the grooves is advantageous in a stable carrying performance of developer compared to the development sleeve subjected to the sandblast process because the wear volume is less even if the development sleeve having the outer surface provided with the grooves is used for a long period of time.

However, the amount of the developer carried in the grooves of the outer surface of the development sleeve is larger than the amount of the developer carried in a portion without having the grooves, so that a periodic variation in an image concentration due to the grooves, i.e., pitch unevenness occurs. In general, the deeper the groove, the greater is the carrying performance of the developer obtained, but pitch unevenness easily occurs by a difference in development electrolytic intensity according to the existence or non-existence of the grooves. In contrast, from an electrolytic intensity standpoint, pitch unevenness does not easily occur if the groove is narrow. However, pitch unevenness easily occurs by the shortage of the drawn developer amount caused by increased deterioration in a developer-carrying performance when toners, additives or carriers of developer are accumulated in the groove.

As a countermeasure against the above-described problem, Japanese Patent Application Publication No. 2003-255692 describes that the depth of the groove of the development sleeve is set to be 0.1 mm or more and 0.15 mm or below so as to maintain the carrying performance of the developer while preventing pitch unevenness. However, in recent years, pitch unevenness is easily distinguished because development reproducibility is improved owing to progress in an image-forming technique by adoption of smaller diameter toners and carriers and close contact development in order to obtain a high quality image. Pitch unevenness is significantly distinguished by a development method using small diameter toners having an 8.5 μm average particle diameter, for example, because that method is sensitive to the variation in the developer amount in order to improve image reproducibility. Accordingly, pitch unevenness occurs in the image-forming apparatus described in Japanese Patent Application Publication No. 2003-255692.

Part of the reason for pitch unevenness is a decrease in image concentration by a decrease in the amount of developer 203 caused by the slippage of the developer 203 on the outer surface of a development sleeve 200 without having a groove 202 in a development area D where the development sleeve 200 faces a photoreceptor drum 201 as illustrated in FIGS. 23, 24. The developer 203 generally moves in the development area D where the development sleeve 200 faces the photoreceptor drum 201, but it is necessary to feed a large amount of the developer 203 to the development area D so as to obtain a sufficient image concentration.

For this reason, the development sleeve 200 usually rotates at a surface speed of 1.1-2.5 times of that of the photoreceptor drum 201. The friction against the relatively low speed photoreceptor drum 201 becomes a load resistance when the developer 203 passes through the development area D at high speed, so that the slippage of the developer 203 and a shortage of the amount of the drawn developer 203 occur on a part of the outer surface of the development sleeve without having the groove 202, as illustrated in FIG. 23. Therefore, the developer amount is reduced on the downstream side of the rotation direction of the development sleeve 200 compared to that on the upstream side in the development area D. In contrast, as illustrated in FIG. 24, the developer 203 does not slip and a sufficient amount of the drawn developer is obtained because an effective carrying performance is obtained while the grooves pass in the development area D. Namely, the amount of the developer 203 fluctuates according the presence or the absence of the slippage in a period of the groove 202 passing in the development area D, and pitch unevenness thus occurs by the image concentration difference.

Japanese Patent Application Publication No. 2004-191835 proposes an image-forming apparatus. The image-forming apparatus uses toners having a volume average particle diameter of 4 μm or more and 8.5 μm or below as developer, and includes on an outer surface of a development sleeve a plurality of grooves each extending in the longitudinal direction. The interval between adjacent grooves is set smaller than the width of the development area where the developer has contact with the photoreceptor drum in the surface movement direction of the photoreceptor drum. According to such an image-forming apparatus, at least one groove of the development sleeve always exists in the development area, so that the groove controls the slippage of the developer carried on the development sleeve. Accordingly, the variation in the amount of the developer is reduced in the development area compared to the case in which the groove of the development sleeve does not exist in the development area. Therefore, pitch unevenness due to the image concentration difference is difficult to be distinguished while a high quality image with good image reproducibility is formed even if small diameter toners having a volume average particle diameter of 8.5 μm or below are used.

It is required to narrow an interval between the grooves in the development sleeve described in Japanese Patent Application Publication No. 2004-191835A. However, a method of forming a groove by means of a die with a process which extrudes an aluminum tube with a cold working process is limited. Moreover, the deviation of the depths of the grooves is increased in a cutting process or a grinding process as a finishing process of the external form measurement even if an interval capable of forming a groove is obtained, so that unevenness in an image concentration resulting from the deviation of the groove depths occurs.

On the other hand, a method of grinding one groove or a plurality of grooves at one time as a method of forming a groove can narrow the interval between the grooves and reduce the deviation of the groove depths, but such a method increases the number of processes, resulting in an increase in the costs.

In the electromagnetic blast process illustrated in Japanese Patent Application Publication No. 2007-86091, it is possible to control the decrease in the carrying amount of the developer with the passage of time. However, it is difficult to set a process condition which can obtain a long operating life while acquiring a suitable drawing amount of the developer because linear materials are randomly crushed on the outer surface of the development sleeve, and it is also difficult to address a further increase in the drawing amount for maintaining a high quality image in a future high speed machine.

The present inventor discloses a development roller which can solve the above problems in Japanese Patent Application Publication No. 2009-80447.

The development roller described in Japanese Patent Application Publication No. 2009-80447 includes a not shown magnet roller and a development sleeve 832 having inside thereof the magnet roller, which is rotatably supported and absorbs developer on an outer surface by the magnetic force of the magnet roller as illustrated in FIGS. 25A-25C. The development sleeve 832 includes on the outer surface thereof many depressions 839 having an elliptical shape in a planar view. The many depressions 839 are regularly provided at intervals so as to avoid the overlapping of the depressions.

By providing many depressions 839 on the outer surface of the development sleeve as described above, the wear of the depressions 832 with the passage of time does not easily occur, so that the decrease in the developer-carrying amount with time can be controlled. Moreover, since the developer is accumulated in the depressions 839, the portions in which the developer is accumulated on the outer surface are disposed at intervals. Unevenness in an image can be thereby prevented. Furthermore, it is possible to easily set a process condition which can ensure a long operating life while acquiring a suitable drawing amount of the developer, and provide a superior processing performance which can effectively form the depressions under a set condition.

An image having a high image area rate is often output with colorization in a recent image-forming apparatus, so uniformity of an image concentration in a solid image is increasingly requested.

In the development roller including the development sleeve having many depressions on the outer surface, the factors involved in the generation of unevenness in an image concentration include the deflection accuracy in the rotation of the development sleeve and the shape accuracy of the depression of the outer surface of the development sleeve.

The development sleeve is formed in a cylindrical shape having a straight shaft center P as illustrated in FIG. 26A. Although it is ideal that the shaft center P coincides with a rotation axis Q, the shaft center P is inconsistent with the rotation axis Q because the straight shaft center P can not be obtained as illustrated in FIGS. 26B, 26C due to an allowable error in manufacturing.

The outer surface of the development sleeve is displaced in the direction orthogonal to the rotation axis Q during the rotation of the development sleeve, namely, so-called deflection occurs if the shaft center P of the development sleeve strains as described above.

The development gap between the development sleeve and the photoreceptor fluctuates according to the rotation of the development sleeve if the deflection of the development sleeve is large, namely, the deflection accuracy is deteriorated. For this reason, the electric field of the development area can not be held constant, so that the toner movement amount to the photoreceptor from the development sleeve fluctuates due to the electric field, causing unevenness in an image concentration. Moreover, the gap between the development sleeve and a doctor blade for controlling the thickness of the developer fluctuates according to the rotation of the development sleeve. For this reason, the developer-carrying amount by the development sleeve can not be held constant, so that the toner movement amount fluctuates similar to the above, causing unevenness in an image concentration.

The developer-carrying amount fluctuates according to the depth of the depression if the shape accuracy of the depression on the outer surface of the development sleeve is deteriorated, specifically, if the deviation of the depths of the depressions is large. The developer-carrying amount by the development sleeve thus varies. Therefore, the toner movement amount from the development sleeve to the photoreceptor fluctuates, causing unevenness in an image concentration, similar to the above.

Unevenness in an image concentration occurs if the deviation of the depths of the depressions is large even if the deflection accuracy of the development roller is improved to avoid variation in the development gap and the like. Moreover, unevenness in an image concentration occurs if the deflection of the development sleeve in the rotation is large even if the deviation of the depths of the depressions is reduced to avoid the variation in the developer-carrying amount by the development sleeve.

It is necessary to improve both of the deflection accuracy of the development sleeve and the shape accuracy of the depression (especially, depression depth accuracy) of the sleeve in order to prevent unevenness in an image concentration in the development roller. However, it is technically difficult to improve both of these at the same time, and the costs are also increased.

SUMMARY

It is, therefore, an object of the present invention to solve the above problems. More specifically, an object of the present invention is to provide a cut-price development roller capable of preventing unevenness in an image concentration caused by deflection of a development sleeve in rotation while controlling the decrease in the carrying amount of developer over time, a development device including the development roller, a process cartridge including the development device, and an image-forming apparatus including the development device.

In order to achieve the above object, one embodiment of the present invention provides a development roller including a magnet roller and a rotatably supported development sleeve including inside thereof the magnet roller, wherein the development sleeve is formed in a cylindrical shape and configured such that a shaft center of the cylindrical shape is inconsistent with a rotation axis of the development sleeve, the development sleeve includes an outer surface provided with many circular or elliptical depressions in a planar view, the depressions being regularly arranged at intervals, and a depth of the depression provided in a portion of the outer surface close to the rotation axis is larger than a depth of the depression provided in a portion of the outer surface far from the rotation axis.

BRIEF DESCRIPTION OF THE DRAWINGS

The accompanying drawings are included to provide further understanding of the invention, and are incorporated in and constitute a part of this specification. The drawings illustrate an embodiment of the invention and, together with the specification, serve to explain the principle of the invention.

DESCRIPTION OF THE PREFERRED EMBODIMENT

Figure 1:
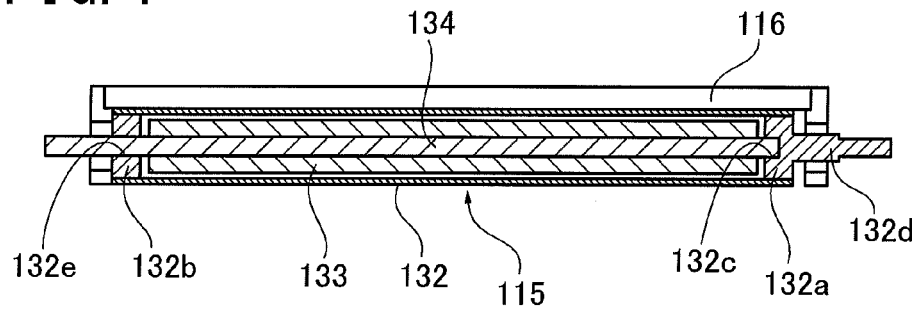
FIG. 1 is a sectional view illustrating one embodiment of a development roller.

The present inventors focused on a relationship between deflection of a development sleeve and a deviation of depression depths on the outer surface of the development sleeve in a development roller including the development sleeve having the outer surface provided with many depressions. As a result, the present inventors found out that unevenness of an image concentration can be prevented by providing a deviation of the depression depths according to a magnitude of the deflection of the development sleeve.

Hereinafter, (A) development roller, (A1) surface processor used in a surface process of a development sleeve of the development roller, (B) development device, (C) image-forming apparatus and process cartridge, and (D) experiments for confirming effects of the present invention will be sequentially described.

An embodiment of the development roller will be described with reference to FIGS. 1-16.

As illustrated in respective figures, a development roller 115 includes a magnet roller 133 and a rotatably supported development sleeve 132 having inside thereof the magnet roller 133. The development sleeve 132 is formed in a cylindrical shape and configured such that a shaft center P of the cylindrical shape is inconsistent with a rotation axis Q of the development sleeve 132, the development sleeve 132 includes an outer surface provided with many circular or elliptical depressions 139 in a planar view, the depressions 139 being regularly arranged at intervals, and a depth of the depression 130 provided in a portion of the outer surface close to the rotation axis Q is larger than a depth of the depression 139 provided in a portion of the outer surface far from the rotation axis Q.

According to such a development roller 115, the development gap between the development sleeve 132 and the after-described photoreceptor drum 108 in the above portion close to the rotation axis Q is larger than that in the above portion far from the rotation axis Q. The electric field which moves toners to the photoreceptor drum 108 from the development sleeve 132 in the portion close to the rotation axis is weaker than that in the portion far from the rotation axis. However, by setting the depth of the depression 139 in the portion close to the rotation axis deeper than that of the depression 130 in the portion far from the rotation axis, the developer-carrying amount in the portion close to the rotation axis can be set larger than that in the portion far from the rotation axis. With this configuration, the weak electric field can be covered, and the toner movement amount to the photoreceptor drum 108 from the development sleeve 132 is increased, so that the toner movement amount of the development sleeve 132 can be equalized in the circumferential direction. Therefore, unevenness in an image concentration in the circumferential direction of the development sleeve 132 due to the deflection of the development sleeve 132 can be cancelled by unevenness in an image concentration due to the deviation of the depression depths, so that the image concentration in the circumferential direction of the development sleeve 132 can be equalized. Moreover, the many depressions 139 provided on the outer surface of the development sleeve 132 are difficult to wear even if they are used over a long period of time. Accordingly, unevenness in an image concentration can be prevented while controlling the decrease in the carrying amount of the developer with time. In addition, the portion close to the rotation axis and the portion far from the rotation axis indicate a relative relationship whether a depression is close to the rotation axis or far from the rotation axis.

Next, the development roller 115 will be described in detail.

The development roller 115 includes the development sleeve 132, the cylindrical magnet roller (magnet body) 133 and a metal columnar cored bar 134 as illustrated in FIG. 1.

Figure 2:
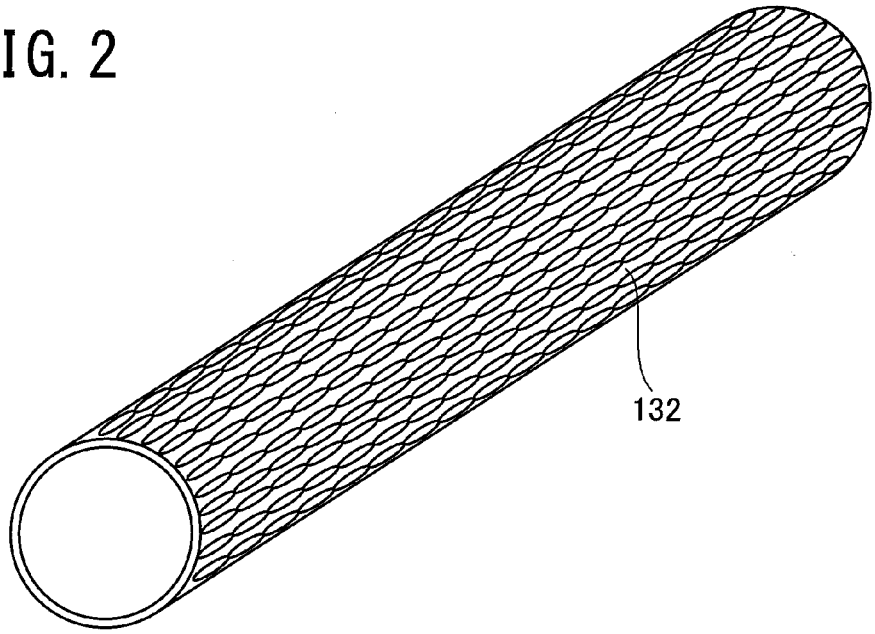
FIG. 2 is a perspective view illustrating a development sleeve of the developer roller in FIG. 1.

The development sleeve 132 is formed in a cylindrical shape as illustrated in FIG. 2.

The development sleeve 132 includes inside thereof the magnet roller 133 and is provided to be rotatable about a cylinder shaft center. The development sleeve 132 rotates such that an inner circumferential face thereof sequentially faces fixed magnetic poles. The development sleeve 132 is made of a non-magnetic material such as aluminum alloy, brass, stainless steel (SUS) or conductive resin.

The aluminum alloy is advantageous in workability and lightness. It is preferable to use A6063, A5056 or A3003 when using aluminum alloy. It is also preferable to use SUS303, SUS304 or SUS 316 when SUS is used. In addition, the development sleeve 132 is made of aluminum alloy in the example illustrated in figures.

It is preferable for the outer diameter of the development sleeve 132 to be about 9-30 mm. It is also preferable for the length of the development sleeve in the longitudinal direction (axis direction) to be about 300-350 mm.

Figure 17A:
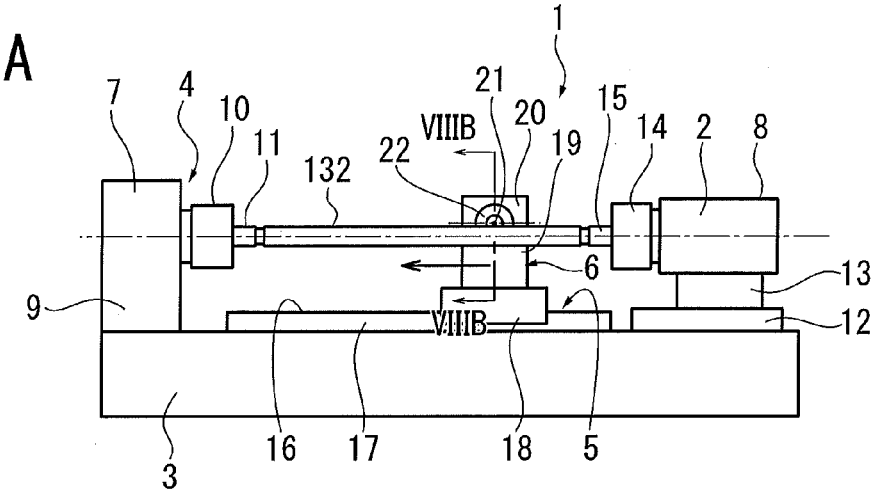
FIG. 17A is a side view illustrating a schematic configuration of a surface processor which cuts out the outer surface of the development sleeve illustrated in FIG. 2.

The outer surface of the development sleeve 132 is subjected to a surface process by a surface processor 1 illustrated in FIG. 17A. Many depressions 139 each having an elliptical shape in a planar view are provided on the outer surface of the development sleeve 132 as illustrated in FIGS. 2, 3, 4A, 5. In addition, the depressions 139 are formed in a circular shape in a planar view.

The depressions 139 are formed on the outer surface of the development sleeve 132, and many (a plurality of) depressions 139 are regularly arranged on the outer surface of the development sleeve 132 so as to avoid the overlapping. In the present invention, the regular arrangement of the depressions 139 means that the intervals between the depressions 139 next to each other in the circumferential direction and the longitudinal direction of the development sleeve 132 are constant. In addition, in FIGS. 3, 4A, 5, the up and down direction is the circumferential direction of the development sleeve 132 and the right and left direction is the longitudinal direction of the development sleeve 132.

The depressions 139 are arranged such that their longitudinal direction is along the longitudinal direction of the development sleeve 132. More specifically, the depressions 139 are arranged such that their longitudinal direction is parallel or is approximately parallel to the longitudinal direction of the development sleeve 132. In the example illustrated in the figures, the longitudinal direction of the depression 139 slightly inclines relative to the longitudinal direction of the development sleeve 132, and is arranged approximately parallel to the longitudinal direction of the development sleeve 132. In the present invention, it is considered that the longitudinal direction of the depression 139 is parallel to the longitudinal direction of the development sleeve 132 when the longitudinal direction of the depression 139 is parallel or approximately parallel to the longitudinal direction of the development sleeve 132.

Figure 3:
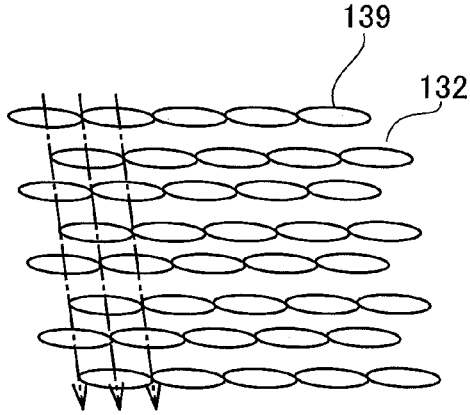
FIG. 3 is a view schematically illustrating a developed outer surface of the development sleeve in FIG. 2.
Figure 4A:
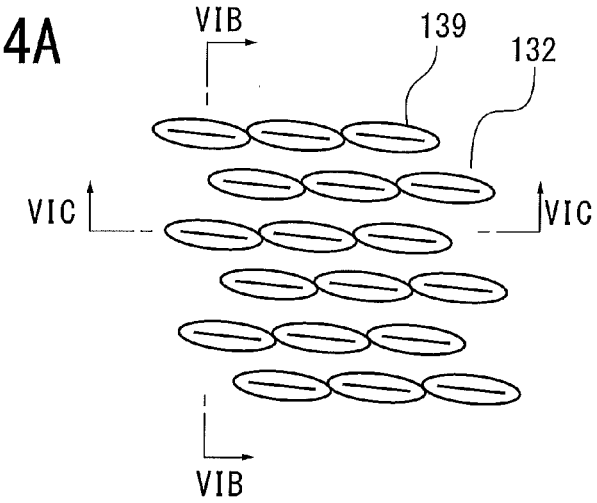
FIG. 4A is a view schematically illustrating an enlarged part of the outer surface of the development sleeve in FIG. 2.
Figure 5:
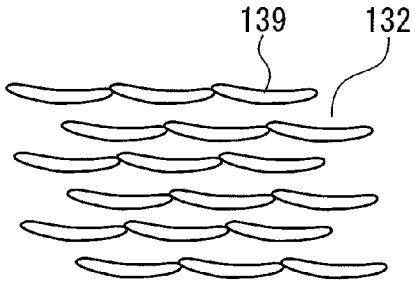
FIG. 5 is a view illustrating an enlarged part of the outer surface of the development sleeve in FIG. 2.

A plurality of depressions 139 is arranged in the longitudinal direction of the development sleeve 132, and the depressions 139 next to each other in the circumferential direction of the development sleeve 132 are arranged in mutually different positions by about a half length of the depression 139 as illustrated in FIGS. 3, 4A, 5, namely are misaligned by about a half length of the depression 139 as illustrated in FIGS. 3, 4A, 5. The depressions 139 are spirally arranged on the outer surface of the development sleeve 132 as illustrated by the dashed line in FIG. 3 because the depressions 139 are formed on the outer surface of the development sleeve 132 by the surface processor 1 illustrated in FIG. 17A.

Figure 4B:
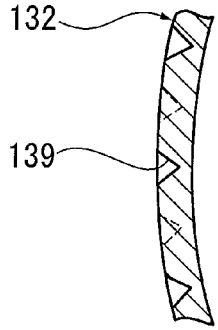
FIG. 4B is a sectional view along VIB-VIB line in FIG. 4A.
Figure 4C:
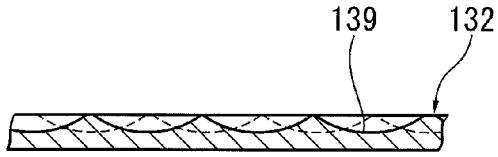
FIG. 4C is a sectional view along VIC-VIC line in FIG. 4A.
Figure 7:
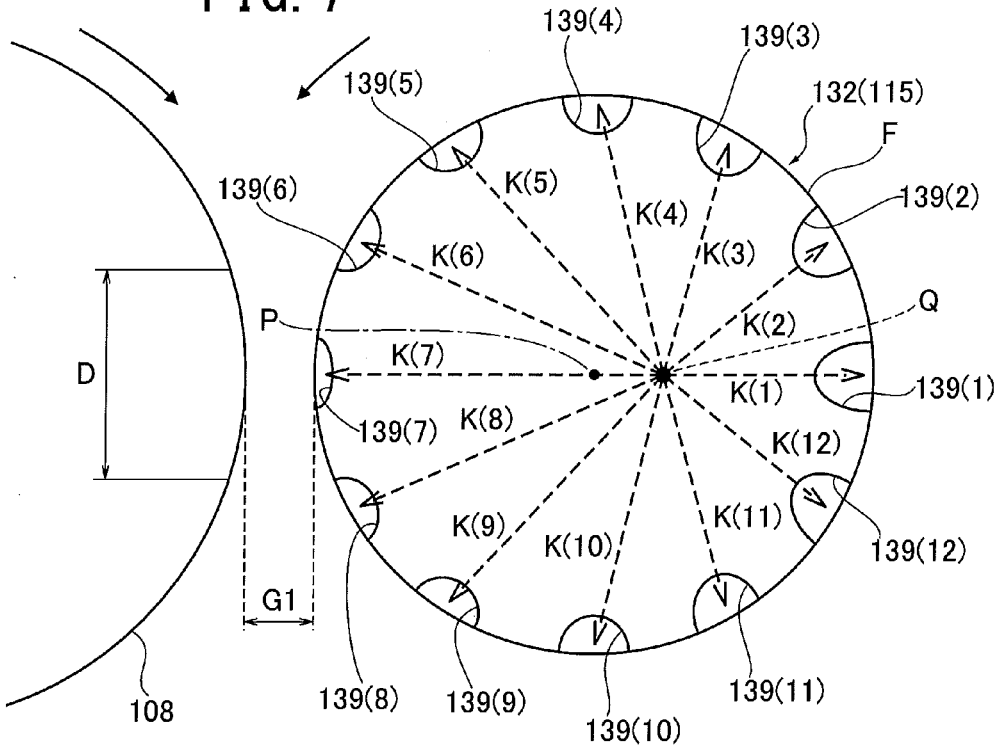
FIG. 7 is a view (0-degree rotation angle) illustrating a positional relationship (distance) between the development sleeve and a photoreceptor drum in the rotation of the development sleeve in FIGS. 6A, 6B.
Figure 8:
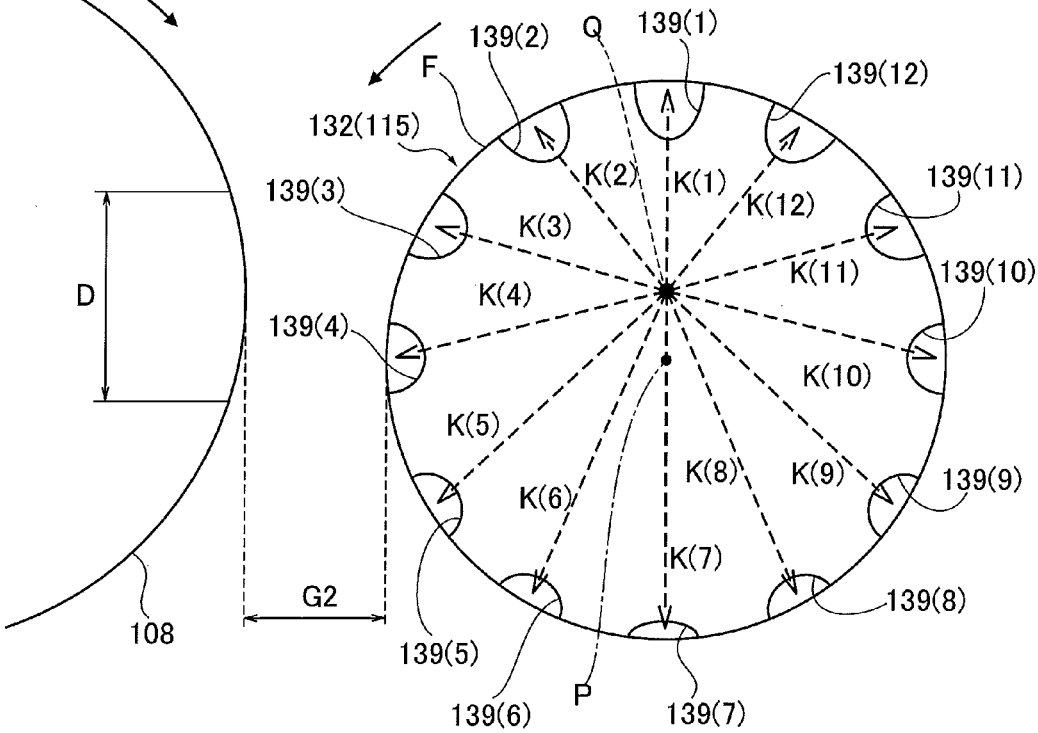
FIG. 8 is a view (90-degree rotation angle) illustrating a positional relationship (distance) between the development sleeve and the photoreceptor drum in the rotation of the development sleeve in FIGS. 6A, 6B.
Figure 9:
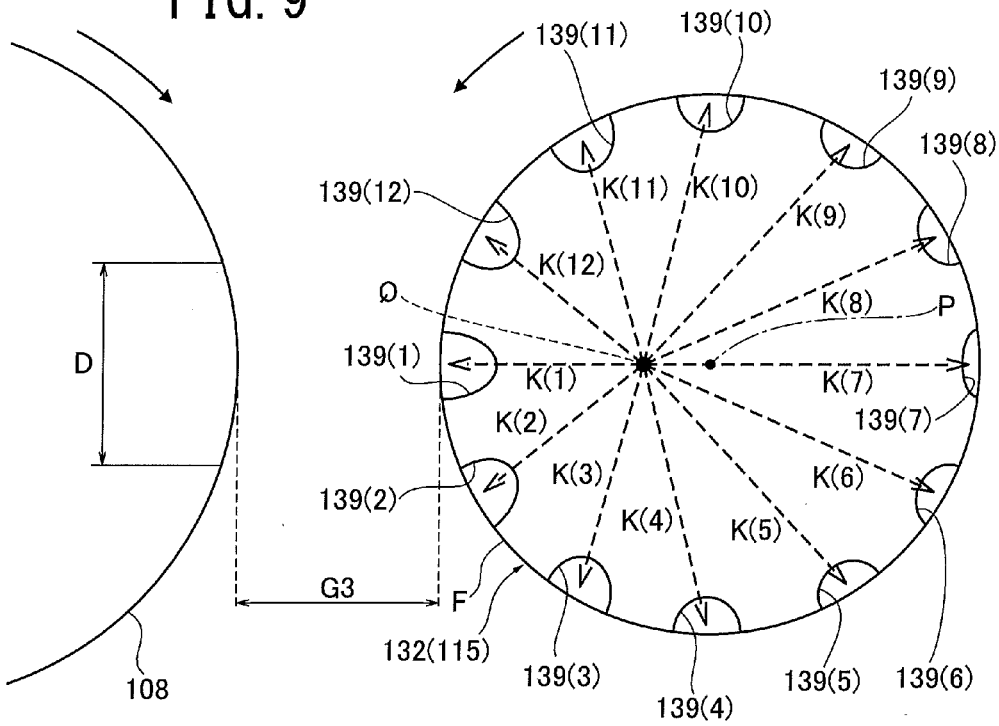
FIG. 9 is a view (180-degree rotation angle) illustrating a positional relationship (distance) between the development sleeve and the photoreceptor drum in the rotation of the development sleeve in FIGS. 6A, 6B.
Figure 10:
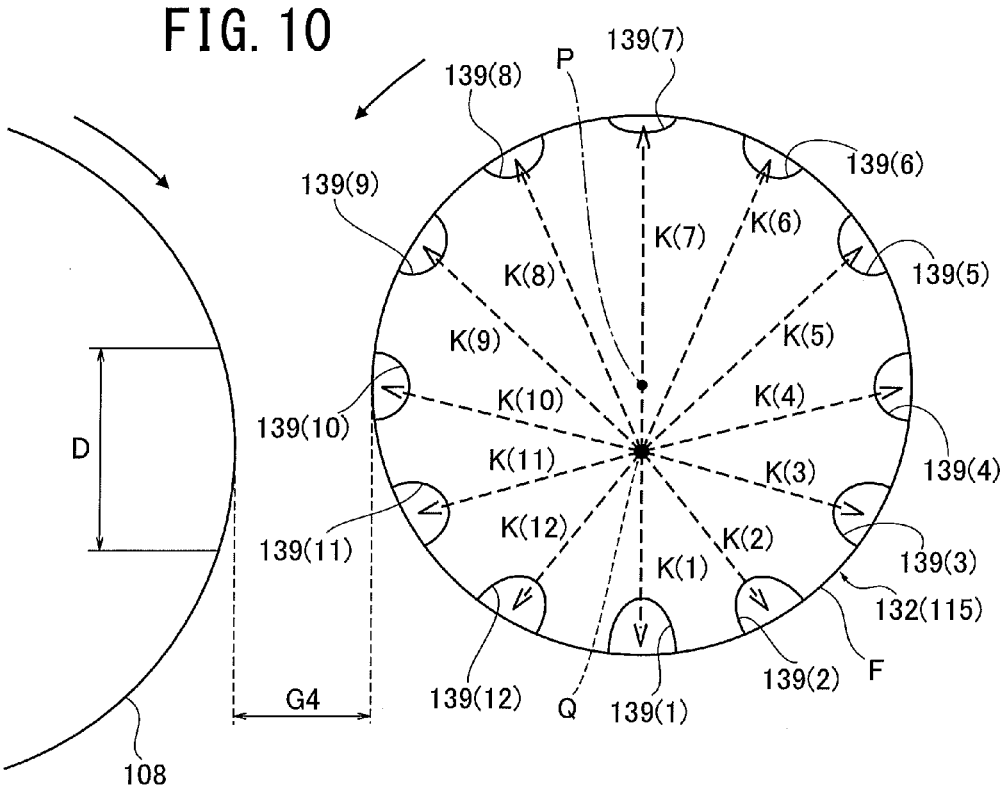
FIG. 10 is a view (270-degree rotation angle) illustrating a positional relationship (distance) between the development sleeve and the photoreceptor drum in the rotation of the development sleeve in FIGS. 6A, 6B.

The depression 139 is formed to have a V-shape in section in the width direction (i.e., circumferential direction of development sleeve 132), as illustrated in FIG. 4B, and to have a circular arc-like curved surface in section in the longitudinal direction (i.e., longitudinal direction of development sleeve 132), as illustrated in FIG. 4C. Moreover, the longitudinal direction of the depression 139 is slightly curved, as illustrated in FIG. 7, because the depression 139 is formed on the outer surface of the development sleeve 132 by the surface processor 1. In the present invention, the depression 139 is considered as an elliptical shape even if its longitudinal direction is different from that illustrated in the figures, its outer edge is formed by a straight line and it is slightly curved as long as the length of the depression is longer than the width of the depression and the outer rim of the depression is formed by a curved line.

The length of the depression 139 in the longitudinal direction (longest diameter) is set to 0.3 mm or more and 2.3 mm or less, the width of the depression 139 in the width direction (shortest diameter) is set to 0.1 mm or more and 0.7 mm or less, and the depth of the depression 139 is set to 0.03 mm and more and 0.15 mm or less. About 50-250 depressions 139 are provided per 100 $mm^2$ of the outer surface of the development sleeve 132. More specifically, the total volume of many depressions 139 is set to 0.5 $mm^3$ or more and 7.0 $mm^3$ or less per 100 $mm^2$ of the outer surface of the development sleeve 132. One or more and three or less depressions 139 are provided per 1 mm in the circumferential direction of the after-described photoreceptor drum 108 rotating together with the development sleeve 132.

In general, the carrying performance of the developer is improved in response to the increase in the depth of the depression 139, but periodical pitch unevenness easily occurs similar to the conventional development sleeve provided with the grooves on the outer surface. On the other hand, narrowing the depth of the depression 139 makes it difficult for the periodical pitch unevenness to occur, although the carrying performance of the developer 126 is deteriorated. In recent years, pitch unevenness easily occurs because image reproducibility is improved owing to progress in an image-forming technique using small particle diameter toners and carriers, progress in an image-forming technique of close contact development and the like. Therefore, the developer-carrying performance is maintained and pitch unevenness is prevented by setting the depths of the depressions 139 of the development sleeve 132 to be narrower and increasing the distribution density of the depressions 139.

A pair of circular plate members 132*a*, 132*b* each having an outer diameter slightly larger than the inner diameter of the development sleeve 132 is pressed in both ends of the development sleeve 132.

One circular plate member 132*a* includes a circular hole 132*a* having a diameter which is approximately the same as that of the cored bar 134 and a columnar driving shaft 132*d* having a cut part of the circumferential face. The hole 132*c* is provided in the center of the face facing the inside of the development sleeve 132. One end of the cored bar is rotatably inserted in the hole 132*c*. The driving shaft 132*d* is provided in the center of the face facing the outside of the development sleeve 132. The driving shaft 132*d* receives the rotation driving force from a not shown development sleeve driver. The other circular plate member 132*b* includes a circular through-hole 132*e* having a diameter which is approximately the same as that of the cored bar 134. The cored bar 134 is rotatably inserted in the through-hole 132*e*.

Namely, the development sleeve 132 is rotatable about the cored bar 134 because a pair of circular plate members 132*a*, 132*b* is rotatably supported.

The behaviors in the rotation of the development sleeve 132 will described below.

Figure 26A:
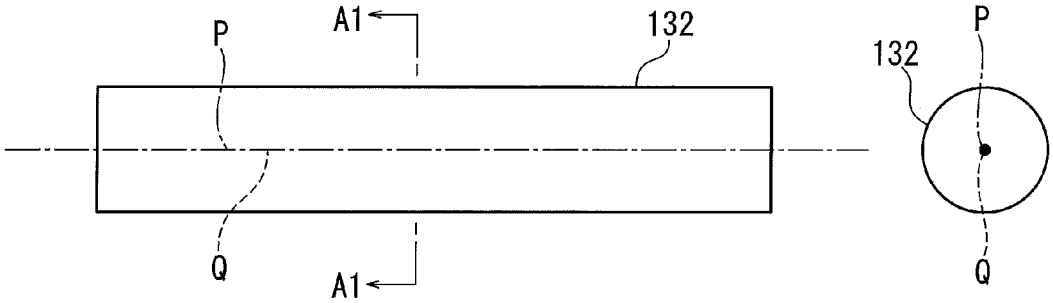
FIG. 26A provides on the left side a side view illustrating a state in which a shaft center of a development sleeve coincides with a rotation axis of a development sleeve and on the right side a sectional view along A1-A1 line.
Figure 26B:
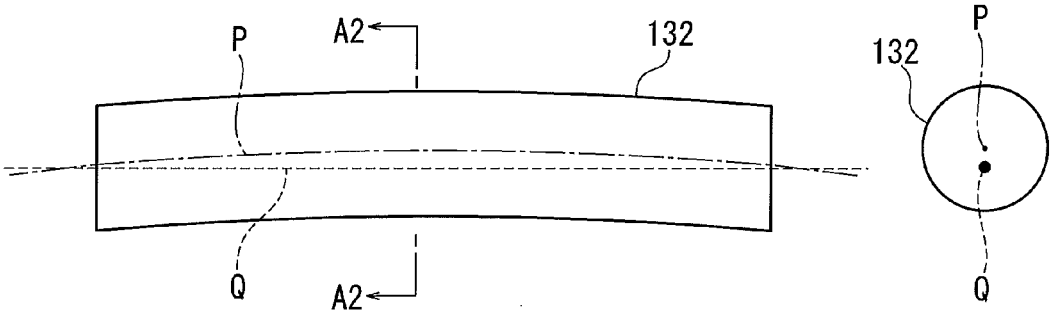
FIG. 26B provides on the left side a side view illustrating a state in which a shaft center of a development sleeve is inconsistent with a rotation axis of a development sleeve and on the right side a sectional view along A2-A2 line.
Figure 26C:
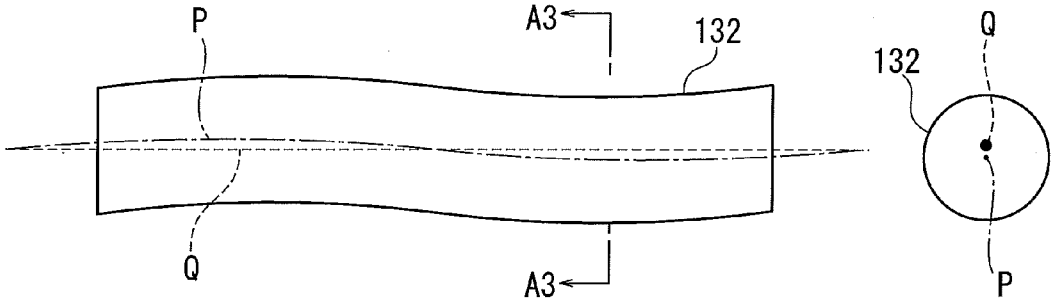
FIG. 26C provides on the left side a side view illustrating another state in which a shaft center of a development sleeve is inconsistent with a rotation axis of a development sleeve and on the right side a sectional view along A3-A3 line.

It is ideal that the development sleeve 132 is formed in a cylindrical shape such that the shaft center P becomes straight and the shaft center P coincides with the rotation axis Q as illustrated FIG. 26A. However, the development sleeve 132 is practically formed such that the shaft center P does not become straight and the shaft center P is inconsistent with the rotation axis Q, as illustrated in FIGS. 26B, 26C, due to allowable errors in manufacturing. There may be a case in which the shaft center P is inconsistent with the rotation axis Q due to other factors such as a shape accuracy of a pair of circular plate members 132*a*, 132*b* or the like.

The development sleeve 132 includes the depression 139 having a depth according to the distance from the rotation axis Q to the outer surface of the development sleeve 132. Namely, the depth of the depression 139 provided in a portion close to the rotation axis Q of the outer surface F of the development sleeve 132 is deeper than the depth of the depression 139 provided in a portion far from the rotation axis Q of the outer surface F of the development sleeve 132.

Figure 6A:
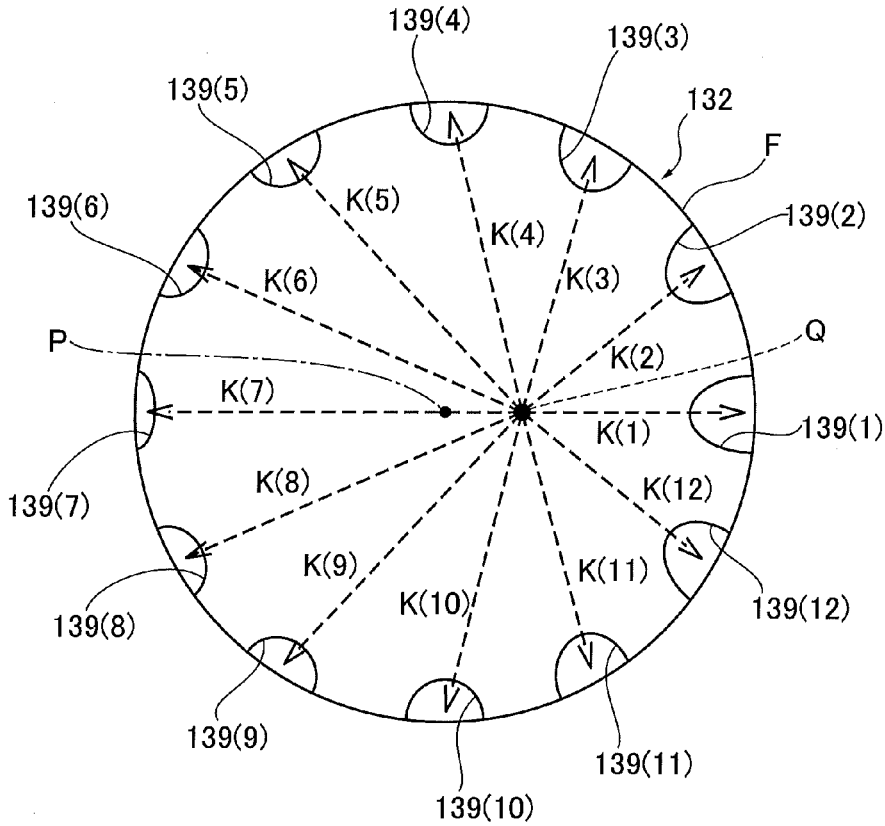
FIGS. 6A, 6B are views each illustrating a relationship between a rotation shaft of the development sleeve in FIG. 2 and a depth of a depression formed on the outer surface of the development sleeve.
Figure 6B:
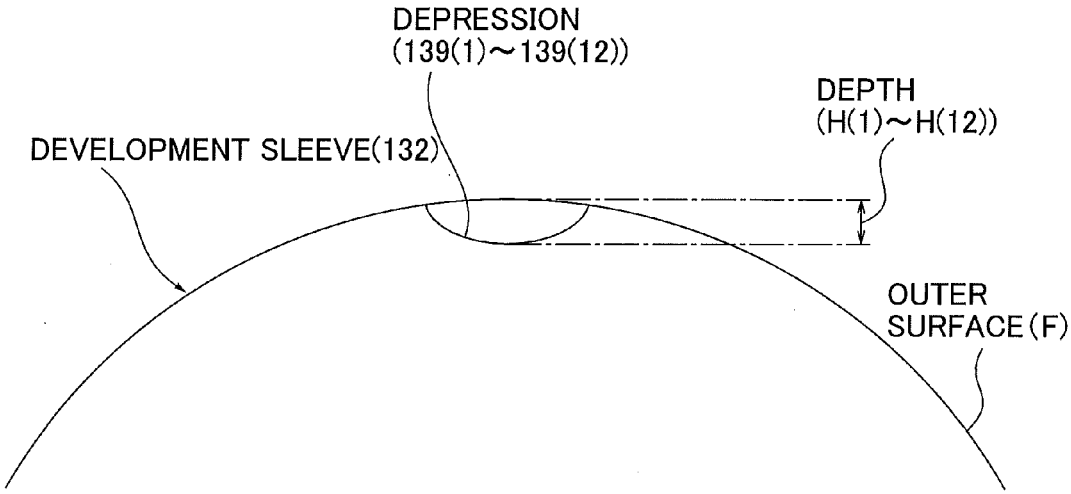

Specifically, as illustrated in FIGS. 6A, 6B as one example, the depressions 139(1)-139(7) provided in the portions where the distances K(1)-K(7) from the rotation axis Q to the outer surface F become, in this regard, K(1)<K(2)<K(3)<K(4)<K(5)<K(6)<K(7) are formed such that the depths H(1)-H(7) of the depressions 139 satisfy the following relationship (1).

$$H(1)>H(2)>H(3)>H(4)>H(5)>H(6)>H(7) \quad (1)$$

The depressions 139(1), 139(7)-139(12) provided in the portions where the distances K(1), K(7)-K(12) from the rotation axis Q to the outer surface F become, in this regard, K(1)<K(12)<K(11)<K(10)<K(9)<K(8)<K(7) are formed such that the depths H(1), H(7)-H(12) of the depressions 139 satisfy the following relationship (2).

$$H(1)>H(12)>H(11)>H(10)>H(9)>H(8)>H(7) \quad (2)$$

The operation of the depressions 139 formed as described above will be described later.

The magnet roller 133 is made of a magnetic material, and is formed in a cylindrical shape. A not illustrated plurality of stationary magnetic poles is attached to the magnet roller 133. The magnet roller 133 is fixed on the outer circumferential face of the cored bar 134 without rotating about the shaft center.

Each of the stationary magnetic poles is a long bar-like magnet, and is attached to the magnet roller 133. The stationary magnetic poles extend in the longitudinal direction of the magnet roller 133, i.e., the development roller 115, and are provided over the enter length of the magnet roller 133. The magnet roller 133 is housed in the development sleeve 132, i.e., the development sleeve 132 includes inside thereof the magnet roller 133.

Figure 21:
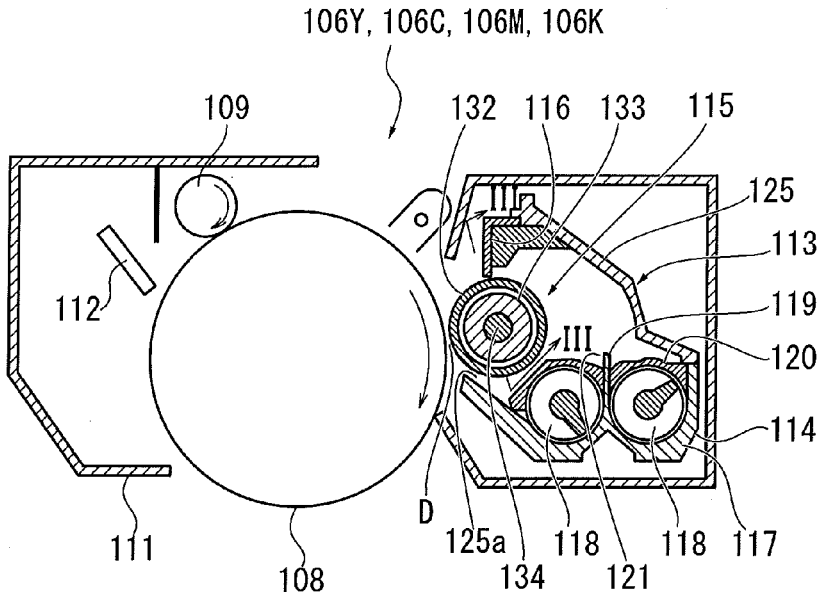
FIG. 21 is a view illustrating one embodiment of a development device and a process cartridge.

One of the stationary magnetic poles faces an agitation screw 118 of the after-described development device 113 (FIG. 21). This stationary magnetic pole is a magnetic pole for drawing developer, generates a magnetic force on the outer surface of the development sleeve 132, i.e., the outer surface of the development roller 115, and absorbs the developer 126 in a second space 121 of a housing tank 117 of the after-described development device 113 on the outer surface of the development sleeve 132.

Another one of the stationary magnetic poles faces the photoreceptor drum 108. This stationary magnetic pole is a development magnetic pole, generates a magnetic force on the outer surface of the development sleeve 132, i.e., the outer surface of the development roller 115, and forms a magnetic field between the development sleeve 132 and the photoreceptor drum 108. This stationary magnetic pole forms a magnetic brush by the magnetic field, and transfers the toners of the developer 126 absorbed on the outer surface of the development sleeve 132 to the photoreceptor drum 108.

At least one stationary magnetic pole is provided between the above-described drawing magnetic pole and the development magnetic pole. This stationary magnetic pole generates a magnetic force on the outer surface of the development sleeve 132, i.e., the outer surface of the development roller 115, feeds the non-use developer 126 to the photoreceptor drum 108, and feeds the used developer 126 in the housing tank 117 from the photoreceptor drum 108.

The stationary magnetic poles overlap a plurality of magnetic carriers of the developer 126 in the magnetic force lines by the stationary magnetic poles upon the absorption of the developer 126 on the outer surface of the development sleeve 132, and nap the carriers on the outer surface of the development sleeve 132. The napping of the magnetic carriers on the outer surface of the development sleeve 132 is a condition in which a plurality of magnetic carriers are overlapped in the magnetic force lines to be provided in a standing manner on the outer surface of the development sleeve 132. Then, the toners absorb on the napped carriers. Namely, the development sleeve 132 absorbs the developer 126 on the outer surface by the magnetic force of the magnet roller 133.

The operation of the development roller 115 will be described with reference to FIGS. 7-10. FIGS. 7-10 are views schematically illustrating the development sleeves 132 which sequentially rotate 90 degrees in the counterclockwise direction.

The development sleeve 132 carries on the outer surface thereof the developer, and feeds the developer to the development area D between the photoconductor drum 108 and the outer surface of the development sleeve 132. The developer (toners) carried by the development sleeve 132 moves to the photoreceptor drum 108 from the development sleeve 132 by the electric field generated in the development area D.

The development gaps G1-G4 between the development sleeve 132 and the photoreceptor drum 108 fluctuate upon the rotation of the development sleeve 132 illustrated in FIGS. 7-10 because the development sleeve 132 is formed such that the shaft center P does not become straight and the shaft center P is inconsistent with the rotation axis Q as described above. The electric filed of the development area D fluctuates owing to the fluctuation in the development gaps. Namely, the electric field of the development area D is reduced in strength in response to the increase in the development gap, and the electric field of the development area D is increased in strength in response to the decrease in the development gap.

The depression 139 (for example, 139(1)) provided in the portion of the outer surface F, which is close to the rotation axis Q, passes through the development area D when the development gap is large, and the depression 139 (for example, 139(7)) provided in the portion of the outer surface, which is far from the rotation axis Q, passes through the development area D when the development gap is small. The depth of the depression 139 provided in the portion of the outer surface F, which is close to the rotation axis Q, is larger than the depth of the depression 139 provided in the portion of the outer surface F, which is far from the rotation axis Q (namely, the depths of the depressions include a deviation). With this constitution, the developer-carrying amount by the depression 139 is large when the development gap is large and the developer-carrying amount by the depression 139 is small when the development gap is small. For this reason, the amount of toners to be moved to the photoconductor drum 108 from the development sleeve 132 can be made uniform by fluctuating the amount of developer to be fed to the development area D according to the variation in the electric field of the development area D.

As described above, the development roller 115 includes the magnet roller 133 and the rotatably supported development sleeve 132 having inside thereof the magnet roller 133. The development sleeve 132 is formed in a cylindrical shape and configured such that the shaft center P of the cylindrical shape is inconsistent with the rotation axis Q of the development sleeve 132, the development sleeve 132 includes the outer surface provided with many circular or elliptical depressions 139 in a planar view, the depressions 139 being regularly arranged at intervals, and the depth of the depression 130 provided in a portion of the outer surface close to the rotation axis Q is larger than the depth of the depression 139 provided in a portion of the outer surface far from the rotation axis Q. According to such a development roller 115, the development gap between the development sleeve 132 and the after-described photoreceptor drum 108 in the above portion close to the rotation axis Q is larger than that in the above portion far from rotation axis Q. The electric field which moves toners to the photoreceptor drum 108 from the development sleeve 132 in the portion close to the rotation axis is weaker than that in the portion far from the rotation axis. However, by setting the depth of the depression 139 in the portion close to the rotation axis deeper than that of the depression 130 in the portion far from the rotation axis, the developer-carrying amount in the portion close to the rotation axis can be set larger than that in the portion far from the rotation axis. With this configuration, the weak electric field can be covered, and the toner movement amount to the photoreceptor drum 108 from the development sleeve 132 is increased, so that the toner movement amount of the development sleeve 132 can be equalized in the circumferential direction. Therefore, unevenness in an image concentration in the circumferential direction of the development sleeve 132 due to the deflection of the development sleeve 132 can be cancelled by unevenness in an image concentration due to the deviation of the depression depths, so that the image concentration in the circumferential direction of the development sleeve 132 can be equalized. Moreover, the many depressions 139 provided on the outer surface of the development sleeve 132 are difficult to wear even if they are used over a long period of time. Accordingly, unevenness in an image concentration can be prevented while controlling the decrease in the carrying amount of the developer with time.

The depression 139 includes a V-shape in section in the circumferential direction of the development sleeve 132, and the depression 139 includes a circular arc shape in section in the longitudinal direction of the development sleeve 132. With this configuration, the amount of the developer housed in the depressions 139 can be increased, and thus, a sufficient amount of the developer can be carried.

The depressions 139 next to each other in the circumferential direction of the development sleeve 132 are arranged in mutually different positions in the longitudinal direction of the development sleeve 132. With this configuration, a portion without having the depressions 139 on the outer surface of the development sleeve 132 and a portion having many depressions 139 on the outer surface of the development sleeve, namely, unevenness in a density of the depressions 139 can be prevented. Therefore, unevenness in developer which is absorbed to the outer surface of the development sleeve 132 can be prevented, namely, the developer can be uniformly absorbed to the outer surface of the development sleeve 132. Accordingly, unevenness in an image can be prevented.

The depressions 139 are spirally arranged on the outer surface of the development sleeve. Wit this configuration, unevenness in developer which is absorbed to the outer surface of the development sleeve 132 can be prevented, namely, the developer can be uniformly absorbed to the outer surface of the development sleeve 132. Accordingly, unevenness in an image can be prevented.

In the above embodiment, the depression 139 includes a V-shape in section in the circumferential direction of the development sleeve 132, and the depression 139 includes a circular arc shape in section in the longitudinal direction of the development sleeve 132. However, the sectional shapes are not limited thereto.

Figure 11A:
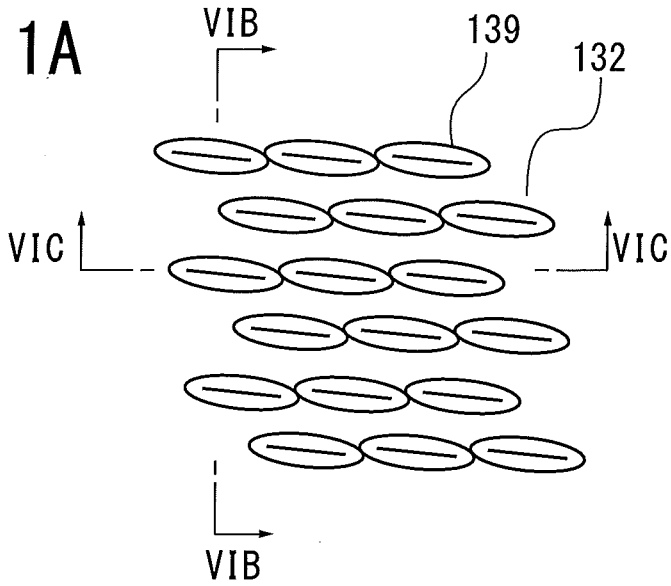
FIG. 11A is a view illustrating a configuration of a modified example of the development sleeve illustrated in FIG. 2 and schematically illustrating an enlarged part of the outer surface.
Figure 11B:
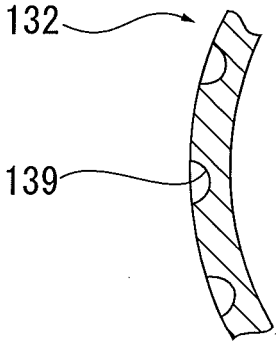
FIG. 11B is a sectional view along VIB-VIB line in FIG. 11A.
Figure 11C:
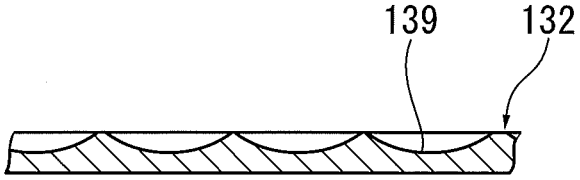
FIG. 11C is a sectional view along VIC-VIC line in FIG. 11A.
Figure 12:
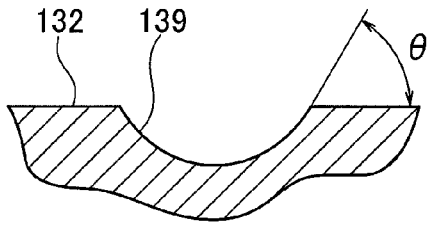
FIG. 12 is a sectional view illustrating an enlarged part of FIG. 11B.

For example, as illustrated in FIGS. 11A-11C, the sectional shape of the depression 139 in the circumferential direction of the development sleeve 132 can be formed in a circular arc shape and the sectional shape of the depression 139 in the longitudinal direction of the development sleeve 132 can be formed in a circular arc shape. With this configuration, similar to the V-shape, the amount of the developer housed in the depressions 139 can be increased, and thus, a sufficient amount of the developer can be carried.

Moreover, it is preferable for an angle θ (refer to FIG. 12) between the outer surface of the development sleeve 132 and the inner surface of the depression 139 in the sectional face in the circumferential direction of the development sleeve 132 to be 60° or below, so as to avoid a development concentration difference caused by the above-described development magnetic poles. In addition, in FIGS. 11A-12, the same reference numbers are applied to the portions which are the same as the portions in the above embodiment.

Figure 13:
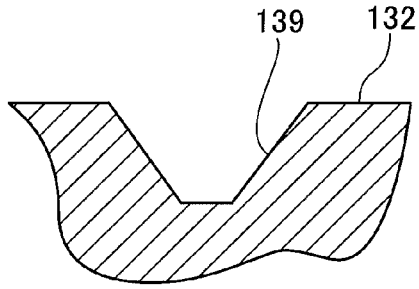
FIG. 13 is a sectional view illustrating a modified example of a depression formed on the outer surface of the development sleeve illustrated in FIG. 4B.
Figure 14:
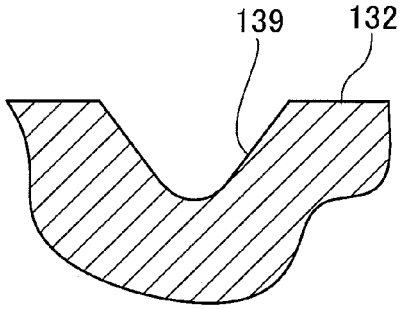
FIG. 14 is a sectional view illustrating another modified example of a depression formed on the outer surface of the development sleeve illustrated in FIG. 4B.

In the above embodiment, the depression 139 includes a V-shape in section in the circumferential direction of the development sleeve 132. However, the sectional shape of the depression 139 in the circumferential direction of the development sleeve 132 can be appropriately changed as illustrated in FIGS. 13, 14. FIG. 13 illustrates the V-shape depression 139 having a flat bottom and FIG. 14 illustrates the V-shape depression 139 having a circular arc bottom. In addition, in FIGS. 13, 14, the same reference numbers are applied to the portions which are the same as the portions in the above embodiment.

Figure 15:
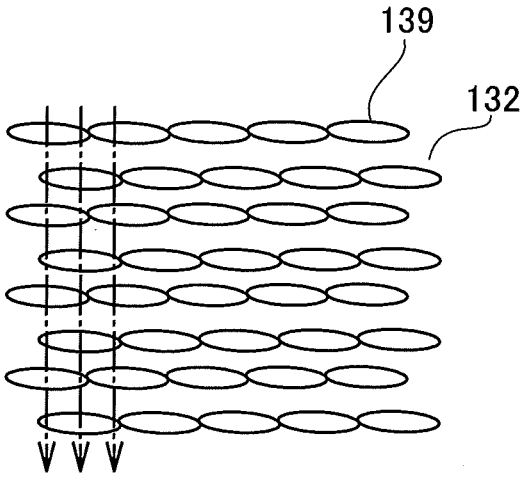
FIG. 15 is a view schematically illustrating a developed outer surface of the development sleeve of the modified example illustrated in FIG. 3.
Figure 16:
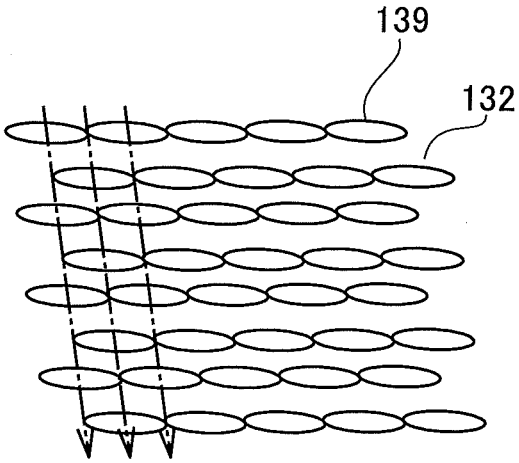
FIG. 16 is a view schematically illustrating a developed outer surface of the development sleeve of another modified example illustrated in FIG. 3.

In the above embodiment, the depressions 139 are spirally arranged on the outer surface of the development sleeve 132, and the each of the depressions 139 are slightly curved. However, the depressions 139 can be arranged linearly in the longitudinal direction of the development sleeve 132 and in the circumferential direction of the development sleeve 132 as illustrated in FIGS. 15, 16.

In the above embodiment, the depressions 139 next to each other in the circumferential direction of the development sleeve 132 are arranged in mutually different positions in the longitudinal direction of the development sleeve 132 by about a half of the length of the depression 139. However, the depressions 139 next to each other in the circumferential direction of the development sleeve 132 can be arranged in mutually different positions in the longitudinal direction of the development sleeve 132 by an arbitrary length, for example, a ⅓ or ¼ of the length of the depression 139.

(A1) Surface Processor

Next, a surface process for use in a surface process of the development sleeve 132 of the development roller 115 will be described.

The depressions 139 are formed on the outer surface of the development sleeve 132 by the surface processor 1 illustrated in FIG. 17A.

The surface processor 1 includes a base 3, a holder 4, a motor 2 as a rotation driver, a tool-shifting unit 5 as a shifter, a tool 6 and a not shown control device as a controller.

The plate-like base 3 is disposed on a floor, table or the like of a factory. The upper surface of the base 3 is maintained parallel to the horizontal direction. The planar shape of the base 3 is rectangle.

The holder 4 includes a fixed holding section 7 and a slide holding section 8. The fixed holding section 7 includes a fixed column 9 provided in the one end portion of the base 3 in the longitudinal direction and a rotation chuck 10 provided in the upper end portion of the fixed column 9. The rotation chuck 10 is formed in a thick circular plate, and is rotatably supported by the upper end portion of the fixed column 9 with the center thereof as a center. The rotation center of the rotation chuck 10 is disposed parallel to the surface of the base 3, and a columnar chuck pin 11 is provided in the central portion of the rotation chuck 10. The chuck pin 11 is disposed coaxially with the rotation chuck 10.

The slide holding section 8 includes a slider 12, sliding column 13, and rotation chuck 14 provided in the upper end portion of the sliding column 13. The slider 12 is provided on the surface of the base 3 to be slidable along the surface of the base 3, i.e., the shaft center of the chuck pin 11 of the rotation chuck 10. The position of the slider 12 is appropriately fixed in the shaft center direction of the chuck pin 11 of the rotation chuck 10.

The sliding column 13 is provided on the slider 12. The rotation chuck 14 is formed in a thick circular plate, and is attached to the output shaft of the motor 2 provided in the upper end portion of the sliding column 13. The rotation center of the rotation chuck 14 is disposed coaxially with the chuck pin 11 of the rotation chuck 10 of the fixed holding section 7. A columnar chuck pin 15 is provided in the central proton of the rotation chuck 14. The chuck pin 15 is disposed coaxially with the rotation chuck 14.

In the holder 4, the development sleeve 132 before the depressions 139 are formed is located between the chuck pins 11, 15 in which the slide holding section 8 is separated from the fixed holding section 7. Then, the slide holding section 8 comes close to the fixed holding section 7, and the leading ends of the chuck pins 11, 15 are inserted into the end portions of the development sleeve 132. Then, the slider 12 is fixed in a state in which the development sleeve 132 is sandwiched between the chuck pins 11, 15. Accordingly, the holder 4 holds the development sleeve 132 while sandwiching the development sleeve 132 between the chuck pins 11, 15. In this case, the holder 4 holds the development sleeve 132 such that the rotation axis of the development sleeve 132 coincides with the rotation axis of the development sleeve 132 when the development roller 115 is attached to the after-described development device 113.

The motor 2 is attached to the upper end portion of the slide column 13 of the slide holding section 8. The motor 2 rotates the rotation chuck 14 about its center. The motor 2 rotates the development sleeve 132 sandwiched between the chuck pins 11, 15 about its shaft center in response to the rotation of the rotation chuck 14.

The tool shifting unit 5 includes a linear guide 16 and a not illustrated actuator for shifting. The linear guide 16 includes a rail 17 and a slider 18. The rail 17 is provided on the base 3. The rail 17 is linearly formed, and the rail 17 is disposed such that its longitudinal direction is parallel to the longitudinal direction of the base 3 and the shaft center of the chuck pins 11, 14, i.e., the development sleeve 132 sandwiched between the chuck pins 11, 15. The slider 18 is supported by the rail 17 to be movable in the longitudinal direction of the rail 17.

The actuator is attached to the base 3, and slides the slider 8 in the longitudinal direction of the base 3 and the shaft center of the chuck pins 11, 15, i.e., the development sleeve 132 sandwiched between the chuck pins 11, 15.

Figure 17B:
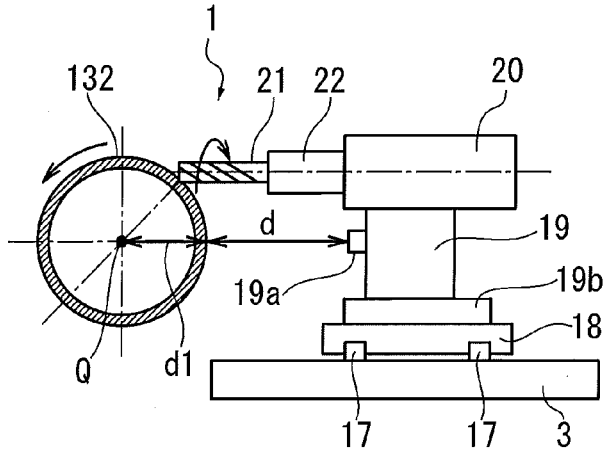
FIG. 17B is a sectional view along VIIIB-VIIIB line in FIG. 17A.

As illustrated in FIG. 17B, the tool 6 includes a tool main body 19, a motor 20 for rotating a tool as a tool rotation section and an end mill 21 as a rotation tool. The tool main body 19 is formed in a columnar shape, and is provided on the slider 18. The tool main body 19 includes a non-contact displacement meter 19*a* for sensing a surface of a sleeve and a piezo actuator 19*b* for controlling a cutout. The non-contact displacement meter 19*a* is disposed in the radial direction (radiation direction) with the rotation axis Q of the development sleeve 132 as a center, and measures a distance d from the non-contact displacement meter 19*a* to the development sleeve 132. With this configuration, the distance d1 from the rotation axis Q to the outer surface can be calculated by deducting the above distance d from a previously set distance from the non-contact displacement meter 19*a* to the rotation axis Q. Moreover, the tool main body 19 is moved in the right-and-left direction relative to the slider 18 in FIG. 17B by the piezo actuator 19*b*, so that the end mill 21 adjusts the cutting depth of the outer surface of the development sleeve 132 (i.e., depth of depression 139).

The motor 20 for rotating a tool is provided on the upper end portion of the tool main body 19. The motor 20 for rotating a tool is disposed in a state in which its output shaft projects from the upper end portion of the tool main body 19 toward the development sleeve 132 sandwiched between the chuck pins 11, 15. The output shaft 22 of the motor 20 for rotating a tool is disposed in a state in which its shaft center is parallel to the surface of the base 3 and intersects with the shaft center of the development sleeve 132 sandwiched between the chuck pins 11, 15 (is orthogonal to the shaft center of the development sleeve 132 in the figure).

The end mill 21 is formed in a columnar shape as a whole, and is attached to the leading end portion of the output shaft 22 of the motor 20 for rotating a tool. With this configuration, the end mill 21 is disposed in a state in which its shaft center is parallel to the surface of the base 3 and intersects with the shaft center of the development sleeve 132 sandwiched between the chuck pins 11, 15 (is orthogonal to the shaft center of the development sleeve 132 in the figure). The end mill 21 is disposed to project from the upper end portion of the tool main body 19 toward the development sleeve 132 sandwiched between the chuck pins 11, 15.

The end mill 21 includes a columnar main body 23 and two cutting blades 24. The main body 23 is attached to the tool main body 19. The cutting blades 24 are disposed in the leading end portion of the main body 23 on the development sleeve 132 side at an interval in the circumferential direction.

The tool 6 may include a not illustrated backup roller, auxiliary roller, copying roller or the like for maintaining the position of the development sleeve 132 against the force to be applied to the development sleeve 132 due to the cutting with the end mill 21. Such rollers are disposed parallel to the development sleeve 132, and the outer surfaces of the rollers have contact with each other.

The tool 6 forms the depressions 139 on the outer surface of the development sleeve 132 upon the rotation of the end mill 21 about the shaft center by the motor 20 for rotating a tool. Moreover, the distance d (i.e., deflection) to the surface of the sleeve is measured by the non-contact displacement meter 19*a* while rotating the development sleeve 132, as illustrated in FIG. 17B, and the positions of the slider 18 and the tool 6 are relatively displaced by operating the piezo actuator 19*b* for controlling a cutout, and the depths of the depressions 139 formed on the outer surface of the development sleeve 132 are controlled according to the distance d.

The controller is a computer including a known RAM, ROM, CPU and the like. The controller connects the motor 2 as a rotation driver, an actuator for moving the tool-shifting unit 5, the motor 20 for rotating the tool 6 and the like. The controller controls these to control the entire surface processor 1.

In the formation of many depressions 139 on the outer surface of the development sleeve 132, the controller rotates the development sleeve 132 about its shaft center by the motor 2 as a rotation driver and rotates the end mill 21 about its shaft center by the motor 20 for rotating a tool, so as to move the tool 6 in the shaft center (longitudinal direction) of the development sleeve 132 by the actuator for moving. The controller controls the cutting blades 24 to intermittently perform the cutting process on the outer surface of the development sleeve 132 according to the rotation of the end mill 21, so as to form many depressions 139.

In this case, the measured distance d to the surface of the sleeve by the non-contact displacement meter 19*a* is fed back to the piezo actuator 19*b* for controlling a cutout, and the tool 6 and the outer surface of the development sleeve 132 are relatively displaced, so as to control the depth of the depression 139. Specifically, the tool 6 is moved in the direction away from the development sleeve 132 such that the depth of the depression 139 is reduced when the distance d is short (namely, the distance d1 from the rotation axis Q to the outer surface is long), and the tool 6 is moved in the direction close to the development sleeve 132 such that the depth of the depression 139 is increased when the distance d is long (namely, when the above distance d1 is short).

The curvature radius of the depression 139 of the development sleeve 132 in the longitudinal direction is defined according to the curvature radius of the outer edge of the cutting blade 24, the depth of the depression 139 is defined according to the cutting amount of the cutting blade 24, and the interval of the depressions 139 in the longitudinal direction of the development sleeve 132 is defined according to the movement speed of the tool 6. The controller controls the motor 2 as a rotation driver, the actuator for moving the tool shifting unit 5 and the motor 20 for rotating the tool 6 to satisfy the following Equation 1 where the number of the depressions 139 provided on the outer surface of the development sleeve 132 in the circumferential direction is n, the rotation number of the motor 2 as a rotation driver, i.e., the rotation number of the development sleeve 132 is N1, the number of cutting blades 24 of the end mill 21 is m and the rotation number of the end mill 21 is N2.

$$N2=N1\times(n/2)/m(n:\text{odd}) \qquad \text{Equation 1}$$

Each of these parameters is appropriately changed by the controller, and the size or density of the depression 139 is freely changed, so that the outer surface of the development sleeve 132 can be processed.

The controller is connected with various input devices such as a keyboard and various display devices such as a display.

Next, a process of manufacturing the development sleeve 132 by applying a cutting process on the outer surface of the development sleeve 132 with the above surface processor 1 will be described.

At first, the number of the development sleeve 132 is input to the controller from the input device. The development sleeve 132 before the depressions 139 are formed is held by the holder 4 after the controller positions the end mill 21 as a rotation tool in the tool 6 in a process start position, i.e., one end portion of the development sleeve 132. In this case, the development sleeve 132 is disposed coaxially with the chuck pins 11, 15.

Upon the input of the operation start command from the input device, the controller drives the motor 2 as a rotation driver, the actuator for moving the tool-shifting unit 5 and the motor 20 for rotating the tool 6 based on the above-described Equation 1. Then, the cutting blades 24 of the end mill 21 rotating about the shaft center intermittently apply the cutting process on the outer surface of the development sleeve 132 to form the depressions 139. Namely, the depressions 139 are formed on the outer surface of the development sleeve 132 by the cutting process with the rotation tool 6 rotating about the shaft center.

The motor 2 as a rotation driver, the actuator for moving the tool-shifting unit 5 and the motor 29 for rotating the tool 6 are simultaneously driven. With this configuration, the end mill 21 and the development sleeve 132 relatively move in the longitudinal direction of the development sleeve 132 while the development sleeve 132 which intersects with the end mill 21 rotates about the shaft center, so that the depressions 139 are formed by applying the cutting process on the outer surface of the development sleeve 132 with the rotation tool 6 rotating about the shaft center.

By changing the position of the end mill to the development sleeve, the angle between the side face of the upstream side in the sectional face in the circumferential direction and the virtual face passing through the center of the circumferential direction of the sleeve and the angle between the side face of the downstream side and the virtual face passing through the center of the sleeve can be adjusted.

The controller stops the motor 2 as a rotation driver, the actuator for moving the tool shifting unit 5 and the motor 20 for rotating the tool 6 upon the completion of the cutting process on the outer surface of the development sleeve 132 after the end mill 21 is located in the processing completion position of the development sleeve 132, i.e., the other end portion of the development sleeve 132. Then, the slide holding section 8 is separated from the fixed holding section 7, the development sleeve 132 in which many depressions 139 are formed on the outer surface is removed from the chuck pins 11, 15 of the holding sections 7, 8, and a new development sleeve 132 is held in the holder 4. Accordingly, many depressions 139 are formed on the outer surface by applying the cutting process on the outer surface of the development sleeve 132, and the above-described development sleeve 132 (refer to, for example, FIG. 2) is obtained.

According to such a surface processor 1, the depressions 139 are regularly disposed. With this configuration, processing conditions which can obtain a long operating life while ensuring the most suitable amount for drawing the developer 126 can be easily set, the depressions 139 can be effectively formed with the set conditions and excellent workability can be obtained.

Moreover, many depressions 139 each of which is long in the longitudinal direction of the development sleeve 132 are regularly disposed on the outer surface of the development sleeve 132, and the total volume of the depressions 139 is set to 0.5 $mm^3$ or more per the area of 100 $mm^2$ of the outer surface of the development sleeve 132, so that a sufficient carrying performance of the developer 126 is obtained.

Unevenness in an image due to unevenness in the carrying performance is prevented by regularly disposing the depressions 139 each having the same shape and measurement, and unevenness in an image due to the slippage of the developer 126 is also prevented by providing many depressions 139 in the development area D because the 1.0 or more depressions 139 of the development sleeve 132 exist per 1 mm of the outer surface of the photoreceptor drum 108 in the circumferential direction.

The developer 126 to be pumped is provided parallel to the longitudinal direction of the development sleeve 132 because the longitudinal direction of the depression 139 is parallel to the longitudinal direction of the development sleeve 132. For this reason, the drawn developer 126 is difficult to fall from the outer surface of the development device 132 even if the development sleeve 132 rotates. Therefore, the elliptical depression 139 has an effect similar to that of the conventionally used groove, so that the amount for drawing the developer 126 can be ensured.

Figure 17C:
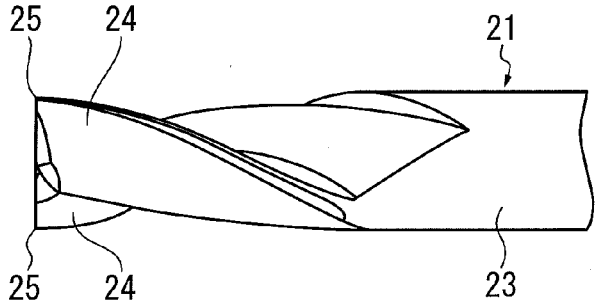
FIG. 17C is a side view illustrating an enlarged end mill illustrated in FIG. 17B.
Figure 17D:
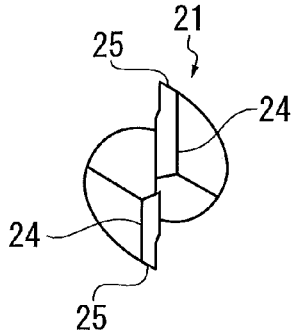
FIG. 17D is a front view illustrating a leading end of the end mill illustrated in FIG. 17C.
Figure 18:
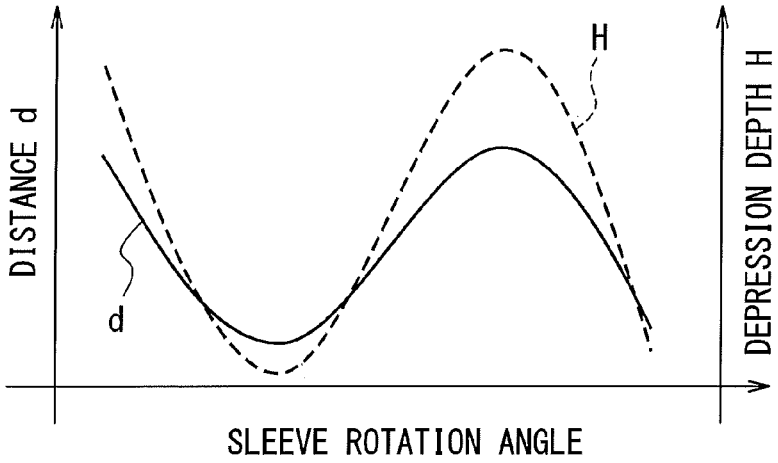
FIG. 18 is a graph illustrating a relationship among a distance to the outer surface of the development sleeve measured by a non-contact displacement meter provided in the surface processor in FIG. 17A, a depth of a depression formed on the outer surface and a rotation angle of the development sleeve.

The sectional shape of the depression 139 in the longitudinal direction of the development sleeve 132 is formed in a V-shape as illustrated in FIGS. 4A-4C by using the end mill 21 in which the outer edges 25 of the cutting blades 24 illustrated in FIGS. 17C, 17D have a sharp angle, and the sectional shape of the depression 139 in the longitudinal direction of the development sleeve 132 is formed in a circular arc shape. The amount of the developer which is housed in the depressions 139 can be increased by forming the depressions as the above shapes, so that a sufficient amount of developer can be carried.

Figure 19:
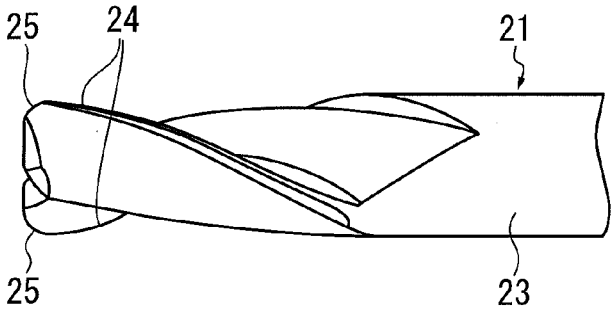
FIG. 19 is a side view illustrating a modified example of an end mill illustrated in FIG. 17C.

The sectional shape of the depression 139 in the circumferential direction of the development sleeve 132 is formed in a circular arc shape as illustrated in FIGS. 11A-11C and the sectional shape of the depression 139 in the longitudinal direction of the development sleeve 132 is also formed in a circular arc shape by using the end mill 21 in which the outer edges 25 of the cutting blades 24 illustrated in FIG. 19 have a circular arc shape. The amount of the developer which is housed in the depressions 139 can be increased by forming the depressions as the above shape, so that a sufficient amount of developer can be carried.

By appropriately changing the shape of the outer edges 25 of the cutting blades 24, the depressions 139 having shapes illustrated in FIGS. 13, 14 can be formed.

The depressions 139 are regularly and effectively formed on the outer surface of the development sleeve 132 because the depressions 139 are formed on the outer surface of the development sleeve 132 by the end mill 21. Accordingly, unevenness in an image can be prevented.

Moreover, the depressions 139 can be regularly and effectively formed on the outer surface of the development sleeve 132 because the depressions 139 are formed by moving the end mill 21 while rotating the development sleeve 132 about the axial center. Accordingly, unevenness in an image can be prevented.

In the above embodiment, the depressions 139 are spirally arranged on the outer surface of the development sleeve 132, and each of the depressions 139 is formed in a circular arc shape by simultaneously and continuously operating the motors 2, 20 and actuator. However, as illustrated in FIGS. 15, 16, the depressions 139 can be formed in a straight line in the longitudinal direction of the development sleeve 132 or many depressions 139 can be formed in a straight line in the circumferential direction of the development sleeve 132 by appropriately and intermittently operating the motors 2, 20 and actuator.

The depressions 139 next to each other in the circumferential direction of the development sleeve 132 can be arranged in mutually different positions in the longitudinal direction of the development sleeve 132 by about a half of the length of the depression 139, and the depressions 139 next to each other in the circumferential direction of the development sleeve 132 can be arranged in mutually different positions in the longitudinal direction of the development sleeve by an arbitrary length, for example, a ⅓ or ¼ of the length of the depression 139.

In the above surface processor, the end mill 21 and the development sleeve 132 are relatively moved by moving the end mill 21 in the longitudinal direction of the development sleeve 132. These can be relatively moved by moving at least one of the end mill 21 and the development sleeve 132 in the longitudinal direction of the development sleeve 132.

Figure 20A:
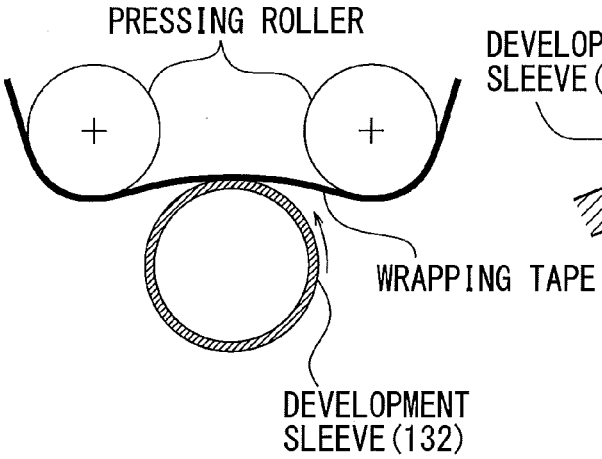
FIGS. 20A. 20B are views each illustrating a surface grinding process of the development sleeve in FIG. 2.

The peripheries of the depressions 139 may include burring because the depressions 139 of the development sleeve 132 are formed by the cutting process. In this case, the development sleeve 132 is grinded by the contact of wrapping tape on the outer surface while rotating in the one direction as illustrated in FIG. 20A for the purpose of removing such burring.

Figure 20B:
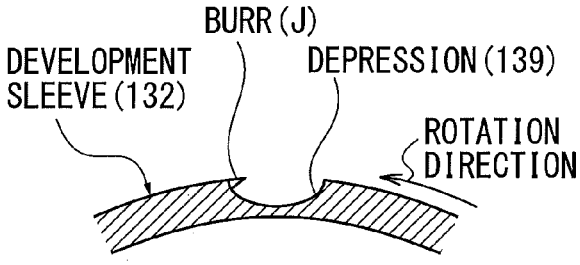

However, the rim of the depression 139 may include burring in a portion on the downstream side of the rotation direction as illustrated in FIG. 20B, if such a surface grinding process is conducted. For this reason, in order to avoid the effect of burring on the carrying performance of the developer, the development roller 115 is provided in the after-described development device 113 so as to rotate the development sleeve 132 in one direction which is the same as in the surface grinding.

(B) Development Device

Next, one embodiment of a development device will be described with reference to FIG. 21.

The development device 113 includes a developer supplier 114, case 125, development roller 115 as a developer carrier, and doctor blade 116 as a regulator as illustrated in FIG. 21.

The developer supplier 114 includes a housing tank 117 and a pair of agitation screws 118 as an agitation member. The housing tank 117 is formed in a box shape having a length which is approximately similar to that of the photoconductor drum 108. The housing tank 117 includes inside thereof a partition 119 extending in the longitudinal direction of the housing tank 117. The partition 119 separates the inside of the housing tank 117 into a first space 120 and a second space 121. Both end portions of the first space 120 and the second space 121 communicates with each other.

Both of the first space 120 and the second space 121 house the developer 126. The developer 126 includes toners and magnetic carriers (magnetic powder). The toners are appropriately supplied to one end portion of the first space 120 further from the development roller 115 than the second space 121. The toners are spherical fine particles manufactured by an emulsion polymerization method or a suspension polymerization process. In addition, the toners may be obtained by breaking a block made of synthetic resin in which various colorants or pigments are mixed and dispersed. The average particle diameter of the toners is 3 μm or more and 7 μm or below. The toners may be formed by a breaking process or the like.

The magnetic carriers are housed in both of the first space 120 and the second space 121. The average particle diameter of the magnetic carriers is 20 μm or above and 50 μm or below.

The agitation screw 118 is housed in both of the first space 120 and the second apace 121. The longitudinal direction of the agitation screw 118 is approximately parallel to the longitudinal direction of the housing tank 117, development roller 115 and photoreceptor drum 108. The agitation screw 118 is provided to be rotatable about its shaft center, and is configured to feed the developer along the shaft center while agitating the toners and magnetic carriers by rotating about the shaft center.

In the example illustrated in the figures, the agitation screw 118 in the first space 120 feeds the developer 126 from one end portion to the other end portion. The agitation screw 118 in the second space 121 feeds the developer 126 from the other end portion to one end portion.

According to the above configuration, in the developer supplier 114, the toners supplied to one end portion of the first space 120 are fed to the other end portion of the first space while being agitated with the magnetic carriers, and the toners are fed to the other end portion of the second space 121 from the other end portion of the first space 120. Then, the toners and the carriers are agitated in the second space 121, and supplied to the outer surface of the development roller 115 while being fed in the shaft center direction.

The case 125 is formed in a box shape, and is attached to the housing tank 117 of the developer supplier 114 to cover the development roller 115 with the housing tank 117. The case 125 includes an opening 125*a* in a portion facing the photoreceptor drum 108.

The development roller 115 is formed in a columnar shape including the development sleeve 132, magnet roller 133 and cored bar 134, and is provided between the second space 121 and the photoreceptor drum 108 and near the above-described opening section 125*a*. The development roller 115 is approximately parallel to both of the photoreceptor drum 108 and the housing tank 117. The development roller 115 is disposed relative to the photoreceptor drum 108 at an interval. The space between the development roller 115 and the photoreceptor drum 108 forms the development area D which absorbs the toners of the developer 126 on the photoreceptor drum 108, and obtains a toner image by developing an electrostatic latent image. The development roller 115 faces the photoreceptor drum 108 in the development area D. The cored bar 134 of the development roller 115 is disposed such that its longitudinal direction is approximately parallel to the longitudinal direction of the photoreceptor drum 108, and is fixed to the case 125 without rotating. The development sleeve 132 of the development roller 115 is rotatably supported to the cored bar 134. The development roller 115 is provided in the development device 113 which rotates the development sleeve 132 in one direction which is the same as that in the surface grinding.

The doctor blade 116 is attached to the above-described case 125 at an interval relative to the outer surface of the development sleeve 132. The doctor blade 116 scrapes the developer 126 having a thickness more than a predetermined thickness on the outer surface of the development sleeve 132 in the housing tank 117, so as to obtain a predetermined thickness of the developer 126 on the outer surface of the development sleeve 132 to be fed to the development area D.

The development device 113 sufficiently agitates the toners and the magnetic carriers in the developer supplier 114, and absorbs the agitated developer 126 on the outer surface of the development sleeve 132 by the stationary magnetic poles. The development device 113 feeds the developer 126 absorbed by a plurality of stationary magnetic poles toward the development area D due to the rotation of the development sleeve 132. The development device 113 absorbs on the photoreceptor drum 108 the developer 126 in which the thickness is controlled to a predetermined thickness by the doctor blade 116. Consequently, the development device 113 feeds the developer carried on the development roller 115 to the development area D, and develops an electrostatic latent image on the photoreceptor drum 108 to form a toner image.

The development device 113 removes the used developer 126 to be housed in the housing tank 117. The used developer 126 housed in the housing tank 117 is sufficiently agitated with another developer 126 in the second space 121 again, and is used for the development of the electrostatic latent image of the photoreceptor drum 108. In addition, the development device 133 operates a not illustrated toner supply controller to supply toners from a not illustrated toner container if a not illustrated toner concentration sensor detects that the concentration of the toners supplied to the photoreceptor drum 108 is decreased, for example.

As described above, the development device 113 includes the development roller 115. With this configuration, unevenness in an image in the circumferential direction due to the deflection of the development sleeve 132 can be cancelled by unevenness in an image concentration due to the deviation in the depths of the depressions, and thus, the image concentration of the development sleeve 132 in the circumferential direction can be equalized. Moreover, many depressions 139 provided on the outer surface of the development sleeve 132 are difficult to wear even if they are used for a long period of time. Therefore, unevenness in an image concentration can be prevented while controlling the decrease in the carrying amount of the developer with the passage of time.

The outer surface of the development sleeve 132 is grinded while rotating in one direction, and the development roller 115 is provided in the development device 113 to rotate the development sleeve 132 in the one direction. The outer surface of the development sleeve 132 is subjected to the surface grinding process while rotating for the purpose of equalizing the condition of the outer surface of the development sleeve 132, but the outer edge of the depression 139 on the outer surface of the development sleeve 132 includes burring J directed to the upstream side in the portion on the downstream side of the rotation direction by the surface grinding process. If the development roller 115 is provided such that the burring J on the outer edge of the depression 139 is directed on the downstream side of the rotation direction, this burring J operates to draw the developer, but this burring wears with long term use, resulting in the decrease in the carrying performance of the developer. Accordingly, the development roller 115 is provided such that the burring J on the outer edge of the depression 139 is directed on the upstream side of the rotation direction by bringing the rotation direction of the development sleeve 132 in line with the rotation direction of the development sleeve 132 in the surface grinding process. For this reason, the effect on the carrying performance of the developer due to the burring on the outer edge of the depression 139 can be avoided, so that the decrease in the carrying performance of the developer due to long term use and the decrease in an image concentration with time can be prevented.

(C) Image-Forming Apparatus and Process Cartridge

Next, one embodiment of an image-forming apparatus and a process cartridge according to the present invention will be described with reference to FIGS. 21, 22.

The image-forming apparatus 101 forms each color image such as yellow (Y), magenta (M), cyan (C) and black (K) on a recording sheet 107 (refer to FIG. 22) as one transfer material. In addition, units corresponding to respective colors of yellow, magenta, cyan and black are illustrated with Y, M, C, K added to the ends of the reference numbers.

Figure 22:
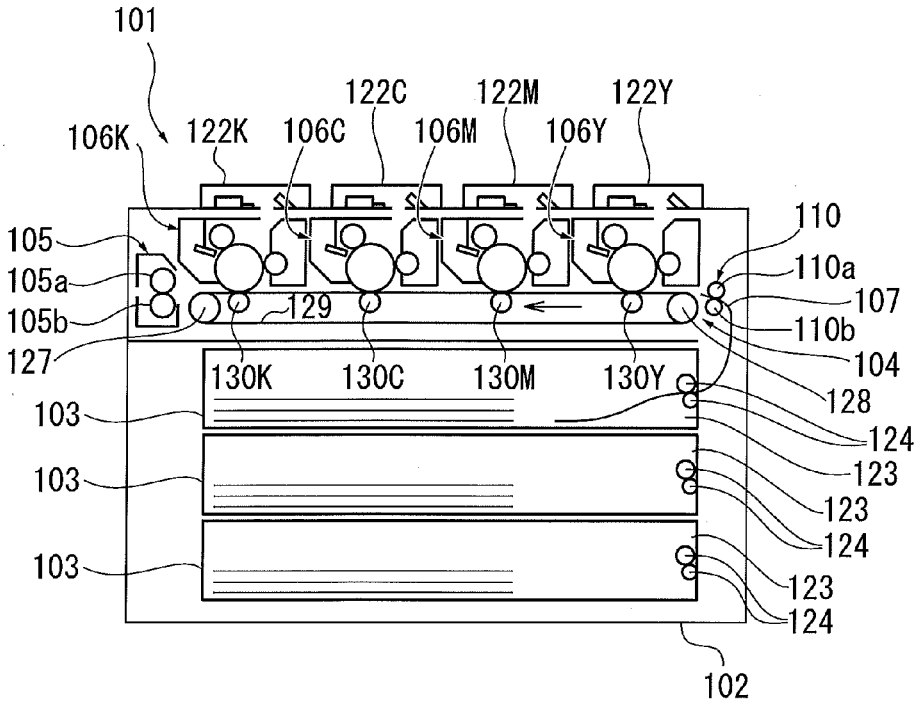
FIG. 22 is a view illustrating one embodiment of an image-forming apparatus.
Figure 23:
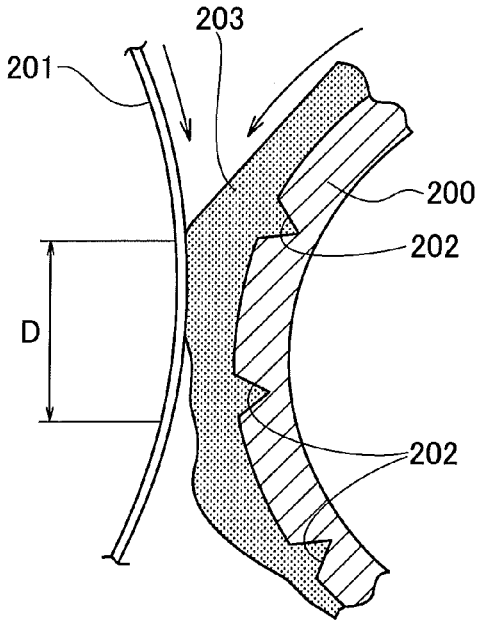
FIG. 23 is a view illustrating a state in which a conventional development sleeve draws developer.
Figure 24:
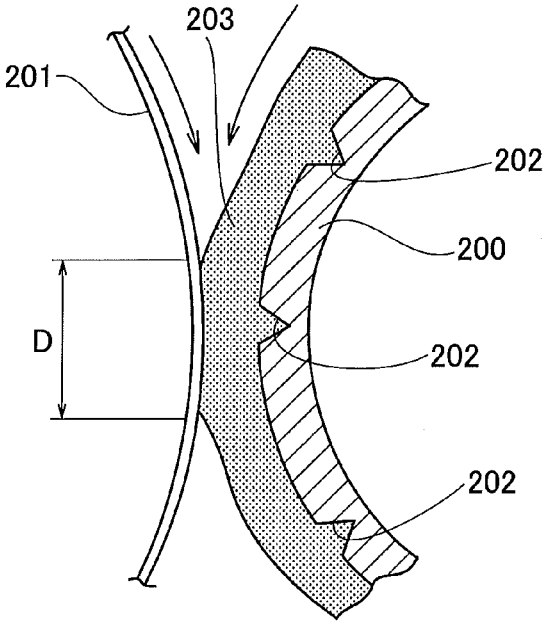
FIG. 24 is a view illustrating another state in which the development sleeve illustrated in FIG. 23 draws developer.
Figure 25A:
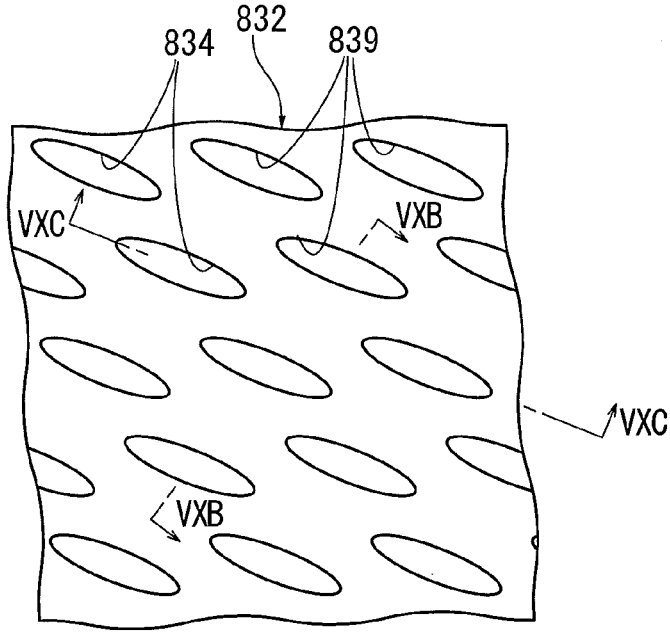
FIG. 25A is a view illustrating an enlarged part of an outer surface of another conventional development sleeve.
Figure 25B:
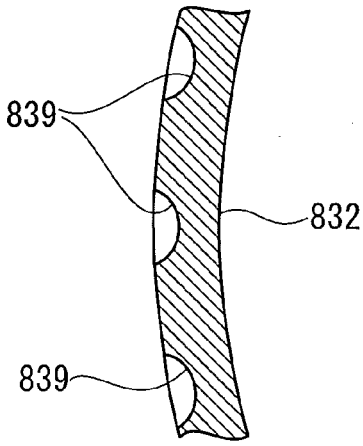
FIG. 25B is a sectional view along VXB-VXB line in FIG. 25A.
Figure 25C:
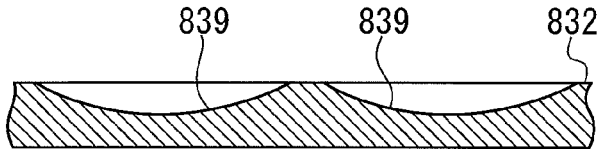
FIG. 25C is a sectional view along VXC-VXC in FIG. 25A.

The image-forming apparatus 101 includes a main body 102, paper feeding unit 103, a registration roller pair 110, transfer unit 104, fusing unit 105, a plurality of laser writing units 122Y, 122M, 122C, 122K and a plurality of process cartridges 106Y, 106M, 106C, 106K as illustrated in FIG. 22.

The main body 102 is formed in a box shape and is disposed on a floor or the like. The main body 102 houses the paper-feeding units 103, a pair of registration rollers 110, transfer unit 104, fusing unit 105, a plurality of laser writing units 122Y, 122M, 122C, 122K and a plurality of process cartridges 106Y, 106M, 106C, 106K.

A plurality of paper-feeding units 103 is provided in the lower portion of the main body 102. Each of the paper-feeding units 103 includes a paper-feeding cassette 123 in which the recording sheets 107 are housed and which is removably attached to the main body 102. The paper-feeding roller 124 is pressed against the top recording sheet 107 in the paper-feeding cassette 123. The paper-feeding roller 124 feeds the top recording sheet 107 to a space between the after-described feeding belt 129 of the transfer unit 104 and the photoreceptor drum 108 of the development device 113 provided in each of the process cartridges 106Y, 106M, 106C, 106K.

The registration roller pair 110 is provided on the feeding path of the recording sheet 107 which is fed to the transfer unit 140 from the paper-feeding unit 103, and includes a pair of rollers 110*a*, 110*b*. The registration roller pair 110 sandwiches the recording sheet 107 between a pair of rollers 110*a*, 110*b*, and feeds the sandwiched recording sheet 107 to the space between the transfer unit 104 and the process cartridges 106Y, 106M, 106C, 106K in a timing which overlaps the toner image on the sandwiched recording sheet 107.

The transfer unit 104 is provided above the paper-feeding units 103. The transfer unit 104 includes a driving roller 127, driven roller 128, feeding belt 129 and transfer rollers 130Y, 130M, 130C, 130K. The driving roller 127 is disposed on the downstream side of the feeding direction of the recording sheet 107, and rotates by a motor as a driving source. The driven roller 128 is rotatably supported to the main body 102, and is disposed on the upstream side of the feeding direction of the recording sheet 107. The feeding belt 129 is wounded around both of the driving roller 127 and the driven roller 128. The feeding belt 129 circulates (endless running) around the driving roller 127 and the driven roller 128 in the counter-clockwise direction in the figure in response to the rotation of the driving roller 127.

The feeding belt 129 and the recording sheet 107 on the feeding belt 120 are sandwiched between the transfer rollers 130Y, 130M, 130C, 130K and the process cartridges 106Y, 106M, 106C, 106K. In the transfer unit 104, each transfer roller 130Y, 130M, 130C, 130K presses the recording sheet 107 fed from the paper-feeding unit 103 against the outer surface of the photoreceptor drum 108 of each process cartridge 106Y, 106M, 106C, 106K, and transfers the toner image on the photoreceptor drum 108 onto the recording sheet 107. The transfer unit 104 feeds the recording sheet 107 on which the toner image is transferred toward the fusing unit 105.

The fusing unit 105 is disposed on the downstream side of the feeding direction of the recording sheet 107 of the transfer unit 104, and includes a pair of rollers 105*a*, 106*b* which sandwiches therebetween the recording sheet 107. The fusing unit 105 presses and heats the recording sheet 107 fed from the transfer unit 104 to the space between a pair of rollers 105*a*, 105*b*, so that the toner image transferred onto the recording sheet 107 from the photoreceptor drum 108 is fused on the recording sheet 107.

The laser writing units 122Y, 122M, 122C, 122K are provided in the upper portion of the main body 102. The laser writing units 122Y, 122M, 122C, 122K correspond to the process cartridges 106Y, 106M, 106C, 106K, respectively. Each of the laser writing units 122Y, 122M, 122C, 122K irradiates laser light on the outer surface of the photoreceptor drum 108 uniformly charged by the after-described charging roller 109, so as to form an electrostatic latent image.

Each of the process cartridges 106Y, 106M, 106C, 106K is provided in a space between the transfer unit 104 and each of the laser writing units 122Y, 122M, 122C, 122K. The process cartridges 106Y, 106M, 106C, 106K are detachably attached to the main body 102, and arranged approximately parallel in the feeding direction of the recording sheet 107.

Each process cartridge 106Y, 106M, 106C, 106K includes a cartridge case 111, a charging roller 109 as a charger, the photoreceptor drum 108 as an image carrier, a cleaning blade 112 as a cleaner and the development device 113, as illustrated in FIG. 21. Therefore, the image-forming apparatus 101 includes at least the charging roller 109, photoreceptor drum 108, cleaning blade 112 and development device 113.

The cartridge case 111 is detachably attached to the main body 102, and houses the charging roller 109, photoreceptor drum 108, cleaning blade 112 and development device 113. The charging roller 109 uniformly charges the outer surface of the photoreceptor drum 108. The photoreceptor drum 108 is disposed at an interval to the development roller 115 of the development device 113. The photoreceptor drum 108 is formed in a columnar shape or cylindrical shape which is rotatable about the shaft center. An electrostatic latent image is formed on the outer surface of the photoreceptor drum 108 by the laser writing units 122Y, 122M, 122C, 122K as the exposure devices. The toners are absorbed on the electrostatic latent image formed and carried on the outer surface of the photoreceptor drum 108, so as to develop the electrostatic latent image. The toner image is transferred onto the recording sheet 107 located between the feeding belt 129 and the photoreceptor drum 108. The cleaning blade 112 eliminates the toners remaining on the outer surface of the photoreceptor drum 108 after transferring the toner image on the recording sheet 107.

The above-described image-forming apparatus 101 forms an image on the recording sheet 107 as illustrated below. In the image-forming apparatus 101, at first the photoreceptor drum 108 rotates, and the outer surface of the photoreceptor drum 108 is uniformly charged to −700 V by the charging roller 109. The outer surface of the photoreceptor drum 108 is irradiated by laser light, the photoreceptor drum 108 is exposed, and an image portion is attenuated to −150 V, so as to form an electrostatic latent image on the outer surface of the photoreceptor drum 108. Then, with the location of the electrostatic latent image on the development area D, the development bias voltage of −550 V is applied to the electrostatic latent image, the developer 126 absorbed on the outer surface of the development sleeve 132 of the development device 113 is absorbed on the outer surface of the photoreceptor drum 108, so as to develop the electrostatic latent image, and the toner image is formed on the outer surface of the photoreceptor drum 108.

Then, the recording sheet 107 fed by the paper-feeding roller 124 of the paper feeding unit 103 is located between the photoreceptor drum 108 of the process cartridges 106Y, 106M, 106C, 106K and the feeding belt 129 of the transfer unit 104, and the toner image formed on the outer surface of the photoreceptor drum 108 is transferred onto the recording sheet 107. In the image-forming apparatus 101, the toner image is fused on the recording sheet 107 by the fusing unit 105. In so doing, a color image is formed on the recording sheet 107.

The untransferred toners remaining on the photoreceptor drum 108 are collected by the cleaning blade 112. The photoreceptor drum 108 from which the remaining toners are removed is initialized by a not illustrated neutralization lamp, and is used for a next image-forming process.

In the image-forming apparatus 101, a process control is performed in order to control the variation in the image quality due to variation in environment and aging. Specifically, at first, a development performance in the development device 113 is detected. An image having a certain toner pattern is formed on the photoreceptor drum 108 under a constant bias voltage, and the image concentration is detected by a not illustrated optical sensor to obtain a development performance from the concentration change. The image quality can be maintained constant by changing a target value of the toner concentration such that the development performance becomes a predetermined target development performance. For example, when the image concentration of the toner pattern detected by an optical sensor is thinner than the target development concentration, a CPU as a not illustrated controller operates a not illustrated toner supply controller to increase the toner concentration, and the toners are supplied from a not illustrated toner container. In this case, the toner concentration is detected by a not illustrated toner concentration sensor. In addition, the image concentration of a toner pattern formed on the photoreceptor drum 108 varies in some degree due to periodical unevenness in an image concentration by the development sleeve 132.

In the above-described image-forming apparatus 101, the process cartridge 106Y, 106M, 106C, 106K includes the cartridge case 111, charging roller 109, photoreceptor drum 108, cleaning blade 112 and development device 113. However, it is not always necessary for the process cartridge to have the cartridge case 11, charring roller 109, photoconductor drum 108 and cleaning blade 112 as long as it includes the development device 113. The above-described image-forming apparatus 101 also includes the process cartridges 106Y, 106M, 106C, 106K which are detachably attached to the main body 102. However, it is not always necessary for the image-forming apparatus 101 to include the process cartridges 106Y, 106M, 106C, 106K as long as it includes the development device 113.

As described above, the process cartridges 106Y, 106M, 106C, 106K (i.e., image-forming apparatus) include the development device 113 having the development roller 115. With this configuration, unevenness in an image in the circumferential direction due to the deflection of the development sleeve 132 can be cancelled by unevenness in an image concentration due to the deviation of the depths of the depressions, and thus, the image concentration of the development sleeve 132 in the circumferential direction can be equalized. Moreover, many depressions 139 provided on the outer surface of the development sleeve 132 are difficult to wear even if it is used for a long period of time. Therefore, unevenness in an image concentration can be prevented while controlling the decrease in the feeding amount of the developer with time.

(D) Test for Confirming Effect of the Present Invention

The present inventors produced development rollers in the following Embodiments 1-3 and Comparative Examples 1-3, and confirmed unevenness in a concentration of an image formed by using the development roller.

Embodiment 1

A development sleeve made of aluminum alloy (A6063) was subjected to a grinding process with a centerless grinder to obtain a 25 mm outer diameter. After that, depressions 139 were formed on the outer surface of the development sleeve 132 by driving the surface processor 1 while using the end mill 21 having a 3 mm outer diameter. In this case, the rotation speed of the development sleeve 132 was 626 rpm, the rotation speed of the end mill 21 was 23200 rpm and the movement speed of the end mill in the longitudinal direction of the development sleeve 132 was 0.5 mm/rev. The end mill 21 was located relative to the development sleeve 132 such that both of an angle between the side face of the upstream side in the sectional face of the circumferential direction and a virtual face passing through the center of the circumferential direction of the sleeve and an angle of the side face of the downstream side and a virtual face passing through the center of the sleeve became 45°. The sectional face of each depression 139 in the circumferential direction of the development sleeve 132 was formed in a circular arc shape having a 0.2 mm curvature radius, and the sectional face of each depression 139 in the longitudinal direction of the development sleeve 132 was formed in a circular arc shape having a 1.5 mm curvature radius. The depressions 139 were regularly arranged such that the interval between the depressions 139 in the circumferential direction of the development sleeve 132 was 0.27 mm, and the interval between the depressions 139 in the longitudinal direction of the development sleeve 132 was 0.5 mm. In this case, the distance d1 from the rotation axis of the sleeve to the outer surface of the sleeve was calculated based on the distance d to the outer surface of the sleeve measured by the non-contact displacement meter 19*a*, and the maximum value dmax and the minimum value dmin of the distance d1 were obtained. As a result, the value deduced as the minimum value dmin from the maximum value dmax, dmax−dmin was 25 μm (namely, large deflection width). In such a sleeve, the depth of the depression 139 in a portion having the maximum value dmax of the distance d1 was set to 0.050 mm and the depth of the depression 139 in a portion having the minimum value dmin of the distance d1 was set to 0.060 mm. Then, the depressions 139 were formed by controlling the cutout amount with the piezo actuator 19*b* according to the distance d1 such that each depression 139 obtains a depth which is inversely proportional to the distance d1 (namely, deviation of depression depths). After that, the development sleeve was grinded by a wrapping tape (HGC 600). The rotation speed of the development sleeve was set to 1520 rpm and the tape feeding speed was set to 60 mm/sec. The rotation direction of the development sleeve in the grinding was set to the direction which was the same as the rotation direction when using the development sleeve. A magnet roller was housed in this development sleeve, and the development roller was manufactured.

Embodiment 2

A development roller was manufactured similar to Embodiment 1 except that in a sleeve having 20 μm of dmax−dmin (namely, middle deflection width), the depth of the depression 139 in a portion having the maximum value dmax of the distance d1 was set to 0.051 mm and the depth of the depression 139 in a portion having the minimum value dmin of the distance d1 was set to 0.059 mm, and the depressions 139 were formed by controlling the cutout amount with the piezo actuator 19*b* according to the distance d1 such that each depression 139 obtains a depth which is inversely proportional to the distance d1 (namely, deviation of depression depths).

Embodiment 3

A development roller was manufactured similar to Embodiment 1 except that in a sleeve having 15 μm of dmax−dmin (namely, small deflection width), the depth of the depression 139 in a portion having the maximum value dmax of the distance d1 was set to 0.052 mm and the depth of the depression 139 in a portion having the minimum value dmin of the distance d1 was set to 0.058 mm, and the depressions 139 were formed by controlling the cutout amount with the piezo actuator 19*b* according to the distance d1 such that each depression 139 obtains a depth which is inversely proportional to the distance d1 (namely, deviation of depression depths).

Comparative Example 1

A development roller was manufactured similar to Embodiment 1 except that in a sleeve having 25 μm of dmax−dmin (namely, large deflection width), the depressions 139 were formed by controlling the cutout amount with the piezo actuator 19*b* such that all of the depressions 139 obtain the same depth of 0.055 mm (namely, no deviation of depression depths).

Comparative Example 2

A development roller was manufactured similar to Embodiment 2 except that in a sleeve having 20 μm of dmax−dmin (namely, middle deflection width), the depressions 139 were formed by controlling the cutout amount with the piezo actuator 19*b* such that all of the depressions 139 obtain the same depth of 0.055 mm (namely, no deviation of depression depths).

Comparative Example 3

A development roller was manufactured similar to Embodiment 2 except that in a sleeve having 15 μm of dmax− dmin (namely, small deflection width), the depressions 139 were formed by controlling the cutout amount with the piezo actuator 19*b* such that all of the depressions 139 obtain the same depth of 0.055 mm (namely, no deviation of depression depths).

Each of the development rollers in Embodiments 1-3 and Comparative Examples 1-3 was incorporated in the image-forming apparatus 101, and 10 solid images each having a standard concentration were formed after and before rotating the development roller 45000000 times (corresponding to feeding 3000000 sheets), namely, 10 initial images and 10 aging images were formed with process conditions such as a −700V photoreceptor surface potential, a −150V exposure potential and a −550V development bias. The developer used for forming the images was a two-component developer which was made of magnetic particles having a 35 μm average volume particle diameter and toners having a 5 μm average volume particle diameter. In this case, the magnetic particles and the toners were mixed by a Henschel mixer, the magnetic particles had a resin coat layer containing charging conditioner with ferrite as a core, and the toners were manufactured by emulsion polymerization, mixed with a coloring material and charging controlling agent with polyester as a main component, and added to silica, titanium oxide or the like. In addition, the toner concentration was adjusted to 7 wt %.

After that, regarding each of the 10 initial images and the 10 aging images, concentrations of three positions in a portion corresponding to one rotation of the development roller were measured by a spectroscopic concentration meter and concentrations of three positions in a portion corresponding the rotation after the above one rotation of the development roller were measured by a spectroscopic concentration meter. Then, a difference between the concentration (namely, the average concentration of the former three positions) in the portion corresponding to one rotation of the development roller and the concentration (namely, the average concentration of the latter three positions) in the portion corresponding to the rotation after the above one rotation was calculated as unevenness in a concentration. Then, the average value of unevenness in a concentration in the initial 10 images was calculated and the average value of unevenness in a concentration in the aging 10 images was calculated, and the average values were judged by using the following judgment standards.

[Judgment Standard for Unevenness in Image Concentration]

- ○ Both of the average values of the concentration unevenness of the initial images and aging images are less than 0.03.
- x At least one of the average values of the concentration unevenness of the initial images and aging images is 0.03 or more.

The average value of the concentrations of the 6 positions in total (the former 3 positions and the latter 3 positions) was calculated as an initial image concentration regarding each of the 10 initial images, and the average value of the concentrations of the 6 points in total (the former 3 positions and the latter 3 positions) was calculated as an aging image concentration regarding each of the 10 aging images. Then, the average value of the initial image concentrations in the initial 10 images and the average value of the aging image concentrations in the aging 10 images were calculated, and were judged by using the following judgment standards.

[Judgment Standard for Decrease in Image Concentration]

- ○ The decrease in the average value of the aging image concentration relative to the average value of the initial image concentration is less than 10%.
- x The decrease in the average value of the aging image concentration relative to the average value of the initial image concentration is 10% or more.

The above evaluation results for Embodiments 1-3 and Comparative Examples 1-3 are illustrated in Table 1.

TABLE 1

| | DEVELOPMENT SLEEVE SHAPE | | EVALUATION RESULT | |
|---|---|---|---|---|
| | DEFLECTION WIDTH | DEVIATION OF DEPRESSION DEPTH | IMAGE CONCENTRATION UNEVENNESS | IMAGE CONCENTRATION DECREASE |
| EMBODIMENT 1 | LARGE | 10 μm | ○ | ○ |
| EMBODIMENT 2 | MEDIUM | 8 μm | ○ | ○ |
| EMBODIMENT 3 | SMALL | 6 μm | ○ | ○ |
| COMPARATIVE EXAMPLE 1 | LARGE | 0 μm | x | ○ |
| COMPARATIVE EXAMPLE 2 | MEDIUM | 0 μm | x | ○ |
| COMPARATIVE EXAMPLE 3 | SMALL | 0 μm | x | ○ |

In Embodiments 1-3, the ranges of the distances d1, namely, the deflection widths of the development sleeves 132 differ as large, medium and small. However, the development roller without having the decrease in the image concentration with the passage of time and without having unevenness in an image concentration was obtained by forming the development sleeves 132 with a deviation of the depression depths by changing the depths of the depressions 139 on the outer surface according to the deflection width of the development sleeve 132. On the other hand, in Comparative Examples 1-3, the ranges of the distances d1, namely, the deflection widths of the development sleeves 132 differ as large, medium and small, similar to Embodiments 1-3. However, unevenness in an image concentration occurred because the depths of the depressions on the outer surface were equalized, and the depths of the depressions did not have a deviation.

The effects of the present invention were confirmed from the evaluation results.

Although the embodiment of the present invention has been described above, the present invention is not limited thereto. It should be appreciated that variations may be made in the embodiment described by persons skilled in the art without departing from the scope of the present invention.

What is claimed is:

1. A development roller, comprising:

a magnet roller; and a rotatably supported development sleeve including inside thereof the magnet roller, wherein the development sleeve is formed in a cylindrical shape and configured such that a shaft center of the cylindrical shape is inconsistent with a rotation axis of the development sleeve, the development sleeve includes an outer surface provided with plural circular or elliptical depressions in a planar view, the depressions being regularly arranged at intervals, and in a cross-sectional plane taken at a specific position along, and normal to, the rotation axis, a depth of a depression, amongst a plurality of depressions intersected by the cross-sectional plane, that is provided in a portion of the outer surface relatively closer to the rotation axis is larger than a depth of another depression, amongst the plurality of depressions intersected by the cross-sectional plane, that is provided in a portion of the outer surface relatively farther from the rotation axis.

2. The development roller according to claim 1, wherein at least one depression amongst the plural depressions includes a V-shape in section in a circumferential direction of the development sleeve, and the depression includes a circular arc shape in section in a longitudinal direction of the development sleeve.

3. The development roller according to claim 1, wherein at least one depression amongst the plural depressions includes a circular arc shape in section in a circumferential direction of the development sleeve, and the depression includes a circular arc shape in section in a longitudinal direction of the development sleeve.

4. The development roller according to claim 1, wherein the depressions next to each other in a circumferential direction of the development sleeve are arranged in mutually different positions in a longitudinal direction of the development sleeve.

5. The development roller according to claim 4, wherein the depressions are spirally arranged on the outer surface.

6. A development device comprising a development roller including a development sleeve, wherein the development roller is made up of the development roller according to claim 1.

7. The development device according to claim 6, wherein the outer surface of the development sleeve is grinded while rotating in one direction, and the development roller is provided to rotate the development sleeve in the one direction.

8. A process cartridge comprising a development device, wherein the development device is made up of the development device according to claim 6.

9. An image-forming apparatus, comprising:

a photoreceptor;

a charging device configured to charge a surface of the photoreceptor;

an exposure device configured to form a latent image on the charged surface of the photoreceptor; and a development device configured to develop the latent image on the surface of the photoreceptor, wherein the development device is made up of the development device according to claim 6.

* * * * *